United States Patent [19]

Renard et al.

[11] Patent Number: 4,815,252

[45] Date of Patent: Mar. 28, 1989

[54] RANDOM SIZE CARTON SEALER

[75] Inventors: Donald J. Renard; Eric D. Renard, both of Green Bay, Wis.

[73] Assignee: Box-O-Matic, Inc., Green Bay, Wis.

[21] Appl. No.: 330

[22] Filed: Jan. 2, 1987

[51] Int. Cl.[4] ..... B65B 7/20

[52] U.S. Cl. ..... 53/383; 53/374; 53/387; 493/142

[58] Field of Search ..... 53/383, 387, 374, 388, 53/491; 493/142; 198/461

[56] References Cited

U.S. PATENT DOCUMENTS

| | | | |
|---|---|---|---|
| 1,417,591 | 5/1922 | Anderson . | |
| 1,987,500 | 1/1935 | Wild . | |
| 2,135,806 | 11/1938 | Fermann et al. | 53/387 X |
| 2,242,177 | 3/1939 | Ferguson . | |
| 2,974,461 | 5/1961 | Demler | 53/383 |
| 3,002,329 | 10/1961 | Cookson et al. . | |
| 3,020,691 | 2/1962 | Oxborrow | 53/375 |
| 3,085,376 | 4/1963 | Ferguson, Jr. et al. . | |
| 3,656,606 | 4/1972 | Comstock et al. | 198/34 |
| 3,664,483 | 5/1972 | Revaz | 198/461 X |
| 3,690,222 | 9/1972 | Schroeder | 53/383 X |
| 3,812,948 | 5/1974 | Luginbuhl | 198/20 |
| 3,821,875 | 7/1974 | Paxton | 53/374 |
| 3,879,922 | 4/1975 | Derderian | 53/374 |
| 3,894,627 | 7/1975 | Jabbusch et al. | 198/34 |
| 4,262,468 | 4/1981 | Marchetti | 53/374 X |
| 4,356,908 | 11/1982 | Embro, Jr. | 198/461 |
| 4,451,027 | 5/1984 | Alper | 198/461 |
| 4,551,964 | 11/1985 | Johnson | 53/374 |
| 4,585,227 | 4/1986 | Muller | 198/425 X |
| 4,672,792 | 6/1987 | Wallin | 53/387 |

*Primary Examiner*—James F. Coan

*Attorney, Agent, or Firm*—Willian Brinks Olds Hofer Gilson & Lione Ltd.

[57] ABSTRACT

A random size carton sealer for folding and gluing carton flaps is disclosed which includes an infeed conveyor; three transfer sections; three flap folding, gluing and compressing sections; and an outfeed section. The cartons to be sealed by the apparatus normally have three sets of top and bottom flaps and two minor flaps for sealing. The infeed conveyor conveys cartons onto the first transfer section. The first transfer section transfers cartons to the first flap folding, gluing and compressing section. The first flap gluing, folding and compressing section seals a first set of top and bottom flaps on a carton and then conveys the carton to the second transfer section. The second transfer section folds a first minor flap on cartons and conveys the cartons to the second flap folding, gluing and compressing section. The second flap gluing, folding and compressing section seals a second set of top and bottom flaps on a carton and then conveys the carton to the third transfer section. The third transfer section transfers cartons to the third flap folding, gluing and compressing section where the third and final set of top and bottom flaps are sealed. A second minor flap on a carton is folded by a minor flap tucker before the carton enters the third flap folding, gluing and compressing section. The sealed cartons are then conveyed by the third flap folding, gluing and compressing section to the outfeed section where the sealed carton comes to rest.

25 Claims, 13 Drawing Sheets

FIG. 3
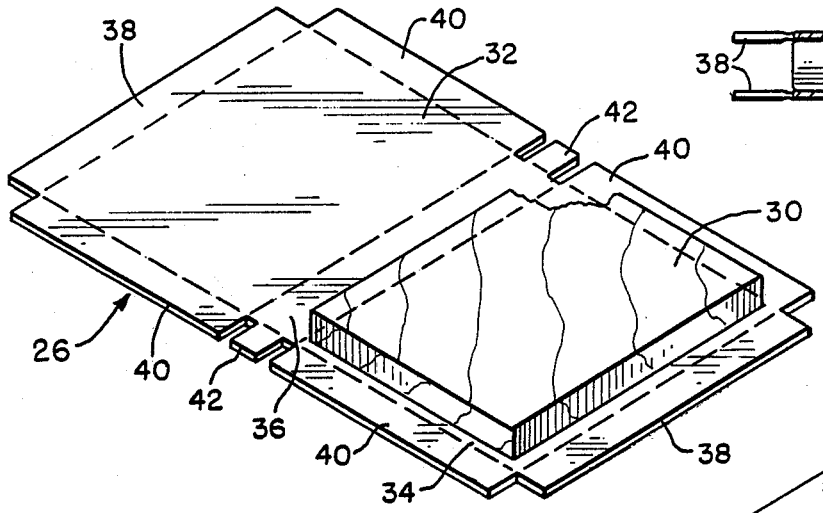
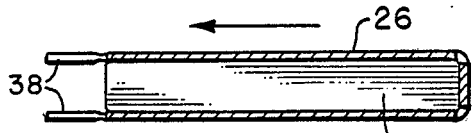
FIG. 4a
FIG. 4
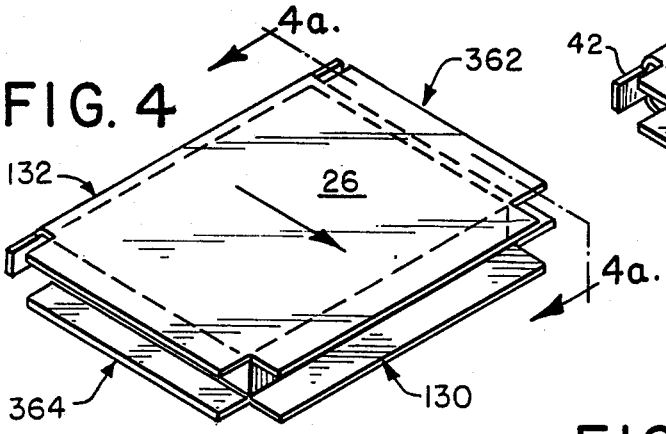
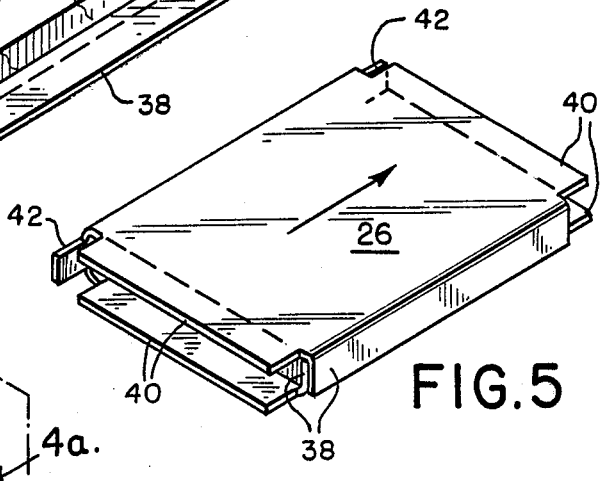
FIG. 5
FIG. 6
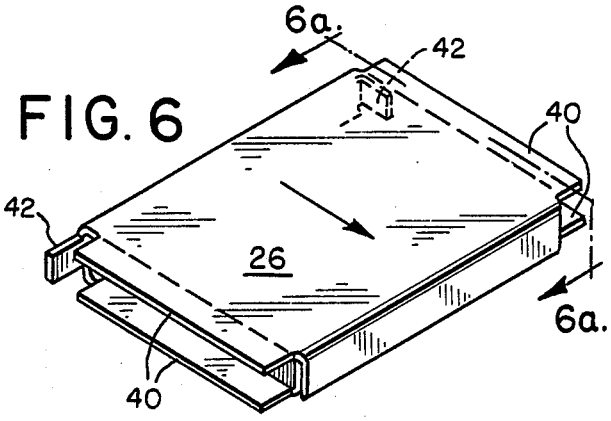
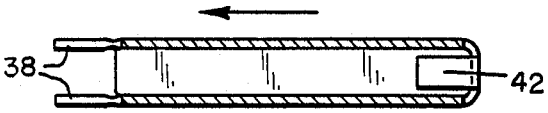
FIG. 6a
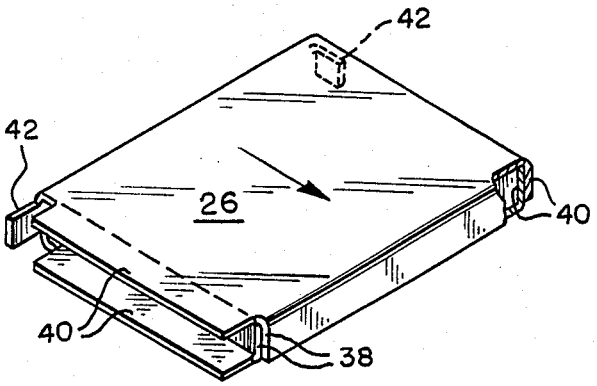
FIG. 7
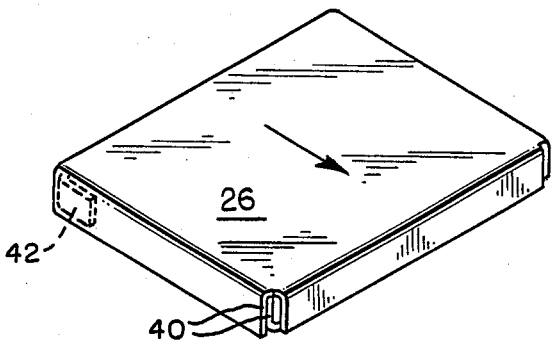
FIG. 8

RANDOM SIZE CARTON SEALER

BACKGROUND OF THE INVENTION

The present invention relates to a random size carton sealer for automatically folding and gluing the flaps on one to three sides of cartons with varying widths, lengths and thicknesses. The cartons are of the type for packaging sheet materials such as sheet metal, insulating panels and plywood. More particularly, the present invention is directed to an improved carton sealer, wherein the improvement is designed to permit the folding and gluing of flaps on a series of cartons, wherein each carton has a length and/or width different from other cartons in the series. The random size carton sealer does not have to be adjusted, either manually or automatically, when the lengths and/or widths of the cartons in the series change.

Carton sealers for sheet materials are known in the art. For example, U.S. Pat. No. 2,974,461 discloses a carton packaging machine for sheet materials.

The machine disclosed in the U.S. Pat. No. 2,974,461 is composed of two principal legs arranged at an angle, the mechanism of one leg being operative to close the sides of a carton package and the mechanism of the other leg being operative to close the ends of the carton package. One drawback with the machine for packaging sheet materials disclosed in the U.S. Pat. No. 2,974,461 patent is its inability to seal all of the flaps on a series of cartons, wherein each carton has a length and/or width different from other cartons in the series, without adjusting the machine. The machine must be adjusted when the lengths and/or the widths of the cartons in the series change.

SUMMARY OF THE INVENTION

The present invention is directed to a random size carton sealer.

According to the preferred embodiment, the random size carton sealer folds and glues the flaps on three sides of a corrugated cardboard carton. The flaps on each side of the carton are folded and glued one side at a time. Initially, filled cartons are manually placed on an infeed conveyor comprising a plurality of driven infeed rollers. The cartons are conveyed to a first transfer section along a first direction of travel for the cartons. The first transfer section comprises a plurality of transfer rollers, each transfer roller continuously driven at a surface speed greater than the surface speed of the infeed rollers. A feed roller, driven at the same surface speed as the transfer rollers, is positioned between the infeed conveyor and the transfer section and serves to speed a conveyed carton up to the speed of the transfer rollers. The infeed rollers and feed roller are intermittently driven by a motor-clutch assembly, wherein the clutch is controlled by a controller, a photo eye located at the inlet to the transfer section and a photo eye located at the inlet to a first flap folding, gluing and compressing section.

The first transfer section also comprises a oneway pusher gate, a pusher arm and a guide fence. The one-way pusher gate pushes cartons completely conveyed onto the first transfer section into contact with the guide fence. The one-way pusher gate is controlled by the controller, a photo eye located at the inlet to the first transfer section and a photo eye located above the guide fence. The pusher arm pushes cartons from the first transfer section into the first flap folding, gluing and compressing section, along a second direction perpendicular to the first direction of travel for the cartons. The pusher arm is controlled by the controller; a photo eye located above the guide fence and a photo eye located at the inlet to the first flap, folding and compressing section.

The infeed conveyor and the first transfer section cooperate to align and deliver cartons to the first flap folding, gluing and compressing section. The cartons are delivered so only one carton is in the first flap folding, gluing and compressing section at a time. The first flap folding, gluing and compressing section comprises an adjustable weight presser plate, an endless presser belt, four endless conveyor belts, two flap folding plows, a gluing means and a flap compressing unit. The adjustable weight presser plate forces the endless presser belt onto the top surface of a carton so that the carton is held between the endless presser belt and the endless conveyor belts. The endless presser belt and the endless conveyor belts cooperate with a carton to move the carton along and force the carton against the flap folding plows, the gluing means and the compressing unit. The flaps on a first side of the carton are folded and glued as they pass along the flap folding plows, the gluing means and the compressing unit.

The weight of the adjustable weight presser plate is adjusted by adding or removing presser plate weights from the adjustable weight presser plate. The endless presser belt and the endless conveyor belts force cartons against the flap folding plows, the gluing means and the compressing rail, thus the weight of the adjustable weight presser plate can be adjusted so that the cartons do not slide relative to the surfaces of the endless presser belt and the endless conveyor belts. In addition, the presser plate's weight must be adjusted so that the force between the carton and the endless presser belt is not so high that it crushes the carton and/or the contents of the carton.

After the flaps on the first side of a carton are sealed, the carton is conveyed onto a second transfer section. The second transfer section comprises a plurality of driven transfer rollers, a pusher arm, a guide fence and a minor flap plow. The driven transfer rollers convey cartons conveyed from the first flap folding, gluing and compressing section into contact with the guide fence. The pusher arm cooperates with the minor flap plow to fold a first minor flap on a carton while it pushes the carton into a second flap folding, gluing and compressing section, along a third direction perpendicular to the second direction. The pusher arm is controlled by the controller, a photo eye located above the guide fence and a photo eye located at the inlet of the second flap folding, gluing and compressing section.

The second flap folding, gluing and compressing section is similar to the first flap folding, gluing and compressing section and folds and glues the flaps on a second side of a carton.

After the first minor flap and the flaps on the second side of a carton are sealed, the carton is conveyed onto a third transfer section. The third transfer section comprises a plurality of driven transfer rollers, a pusher arm, a guide fence and a rising stop gate. The driven transfer rollers convey cartons conveyed from the second flap folding, gluing and compressing section into contact with a rising stop gate. The pusher arm pushes the carton along the rising stop gate into contact with the guide fence. The pusher arm is controlled by the controller, a photo eye located above the stop gate and a photo eye located above the guide fence. The rising stop gate prevents cartons on the third transfer section from being conveyed into the third flap folding, gluing and compressing section until they are in contact with the guide fence. The rising stop gate is lowered when a carton is in contact with the guide fence and is raised after the carton is conveyed into the third flap folding, closing and compressing section. The rising stop gate is controlled by the controller, a photo eye located above the guide fence and a photo eye located at the inlet to the third flap folding, gluing and compressing section. The driven transfer rollers drive cartons on the third transfer section into the third flap folding, gluing and compressing section when the rising stop gate is lowered.

A second minor flap plow and a minor flap tucker are located at the inlet to the third flap folding, gluing and compressing section. The minor flap tucker and the minor flap plow cooperate to close a second minor flap on cartons conveyed from the third transfer section to the third flap folding, gluing and compressing section. The minor flap tucker is controlled by the controller and a photo eye located at the inlet of the third flap folding, gluing and compressing section.

The third flap folding, gluing and compressing section is similar to the first and second flap folding, gluing and compressing sections and folds and glues the flaps on a third side of the carton.

After the second minor flap and the flaps on the third side of a carton are sealed, the carton is conveyed onto an outfeed section. A photo eye located above the outfeed section senses the presence of a carton. The photo eye activates a timer in the controller, which inturn activates a system shut off means if a carton is not removed from the outfeed section within a predetermined amount of time.

The random size carton sealer of this invention is well suited for automatically folding and gluing the flaps on random size cartons. The random size carton sealer uses an endless presser belt and an endless conveyor belt to force a carton against the flap folding plows, the flap gluing means and the compressing unit. The random size carton sealer does not use guide rails or other fixed guide means to force a carton against the flap folding plows, the flap gluing means and the compressing unit, thus the random size carton sealer can seal the flaps on a series of cartons, where each carton has a length and/or width different from other cartons in the series. The random size carton sealer does not have to be adjusted, either manually or automatically, when the lengths and/or widths of the cartons in the series change.

BRIEF DESCRIPTION OF THE DRAWINGS

FIG. 3 is a perspective view of a carton with a panel resting on the bottom wall of the carton.

FIG. 4 is a perspective view of the carton with the top wall of the carton folded onto the top side of the panel.

FIG. 4*a* is a side view of the carton taken along line 4*a*—4*a* of FIG. 4.

FIG. 5 is a perspective view of the carton with the two end flaps of the carton folded and glued.

FIG. 6 is a perspective view of the carton with the first minor flap folded against the panel.

FIG. 6*a* is a side view of the carton taken along line 6*a*—6*a* of FIG. 6.

FIG. 7 is a perspective view of the carton with the first two side flaps folded and glued over the first minor flap.

FIG. 8 is a perspective view of the completed carton with the second two side flaps and the second minor flap folded and glued.

DETAILED DESCRIPTION OF THE PREFERRED EMBODIMENT

Figure 1:
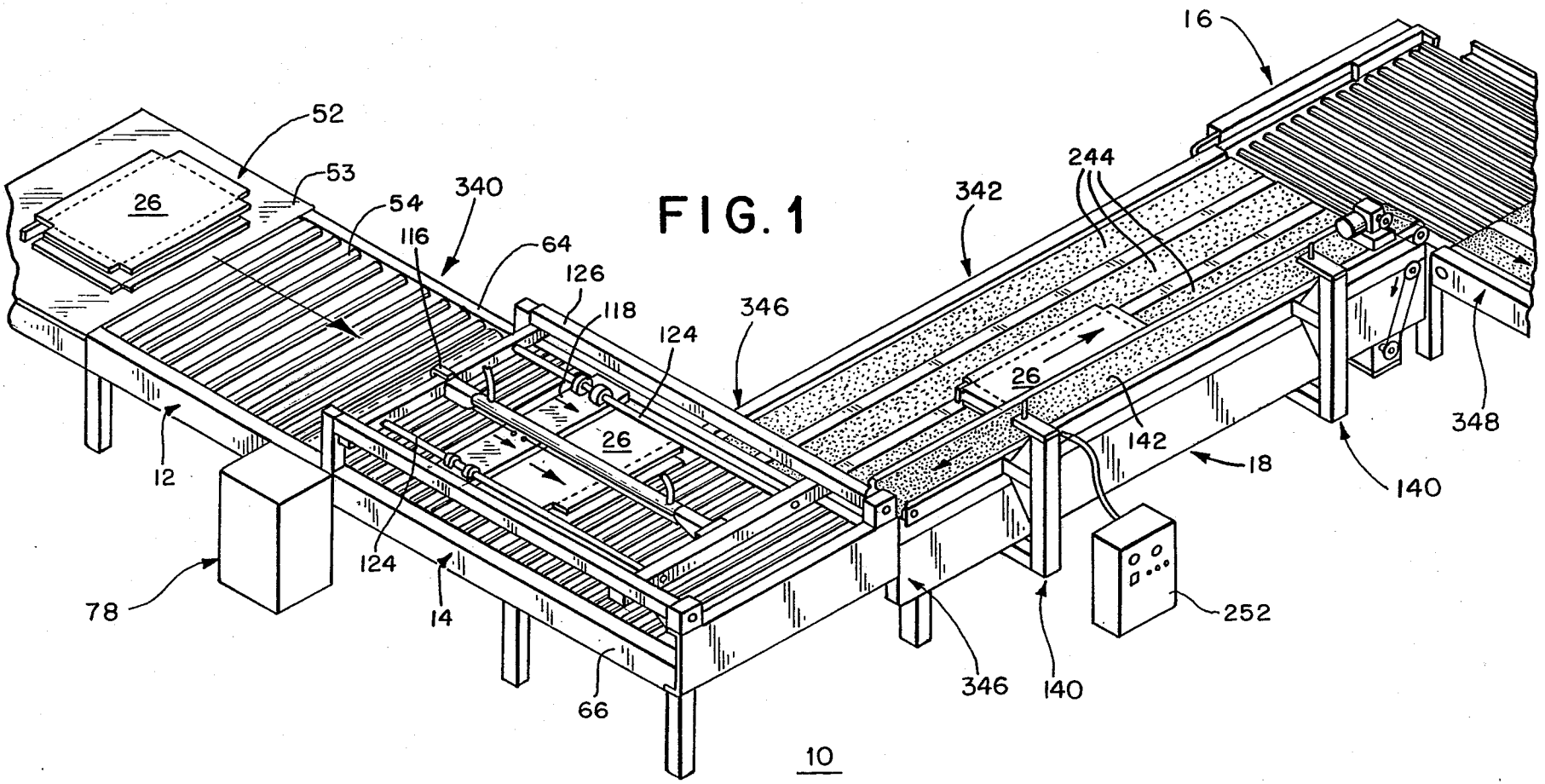
FIG. 1 is a perspective view of the first two legs of the preferred embodiment of the random case sealer.
Figure 2:
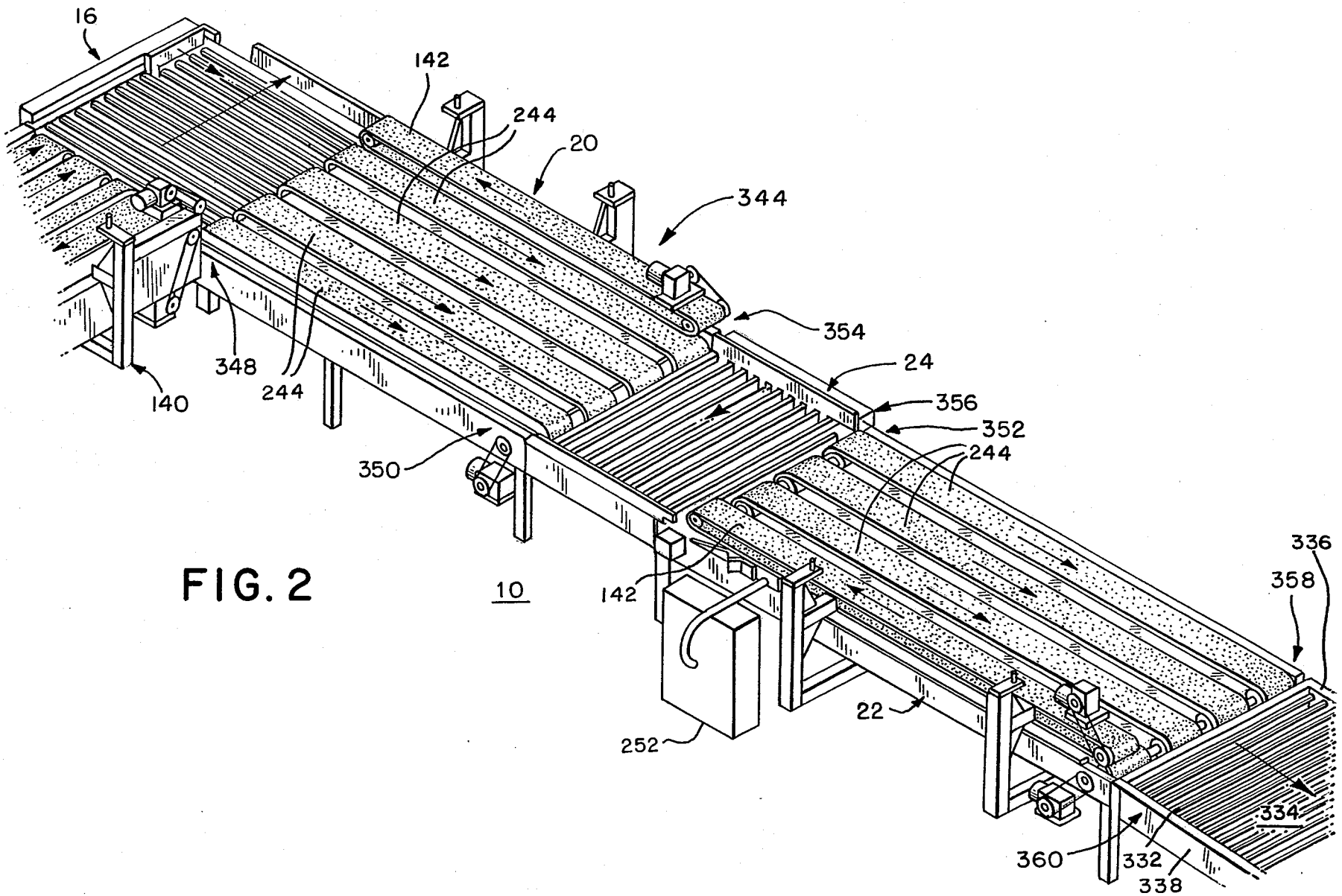
FIG. 2 is a perspective view of the third leg of the preferred embodiment of the random case sealer.

Turning to the drawings FIGS. 1 and 2 illustrate the preferred embodiment of the random size carton sealer 10. FIG. 1 illustrates the first leg 340 and the second leg 342 of the random size carton sealer 10 and FIG. 2 illustrates the third leg 344 of the random size carton sealer 10. The random size carton sealer 10 shown in FIGS. 1 and 2 includes an infeed conveyor 12; a first transfer section 14; a first flap folding, gluing and compressing section 18; a second transfer section 16; a second flap folding, gluing and compressing section 20; a third transfer section 24; a third flap folding, gluing and compressing section 22; and an outfeed section 334.

The preferred embodiment of the random size carton sealer 10 is designed to fold and glue the flaps on cartons 26 such as the carton 26 illustrated in FIGS. 3–8. FIG. 3 illustrates a carton 26 made from corrugated cardboard and an insulating panel 30 to be sealed inside of the carton 26. The carton 26 includes a top wall 32, a bottom wall 34, a rear wall 36, two end flaps 38, four side flaps 40 and two minor flaps 42. FIGS. 4 and 4*a* illustrate the carton 26 with the top wall 32 folded onto the insulating panel 30. When the top wall of the carton 26 is folded over the insulating panel 30, the insulating panel 30 is ready to be placed on the infeed conveyor 12. FIG. 5 illustrates the carton 26 after the two end flaps 38 have been folded and glued together by the first flap folding, gluing and compressing section 18. FIGS. 6 and 6*a* illustrate the carton 26 after the first minor flap 42 has been folded by a pusher arm 278 and a first minor flap plow 286 located on the second transfer section 16. FIG. 7 illustrates the carton 26 after two side flaps 40 have been folded and glued together in the second flap folding, gluing and compressing section 20. FIG. 8 shows the carton 26 after the second minor flap 42 and the last two side flaps 40 have been folded and glued. The second minor flap 42 was folded by a minor flap tucker 322 and a second minor flap plow 324. The last two side flaps 40 were folded and glued together in the second flap folding, gluing and compressing section 20.

Infeed conveyor and First Transfer Section

The infeed conveyor 12 and the first transfer section 14 are shown in FIGS. 9, 10, 11, 12, 13 and 14. FIG. 1 illustrates an assembly table 52 adjoining the infeed conveyor 12. The top of the assembly table 52 has a surface 53 on which cartons 26 are assembled and packed. The table surface 53 is flush with the tops of the infeed rollers 54 and is designed to allow a packed carton 26 to slide from the assembly table 52 to the infeed rollers 54.

Figure 9:
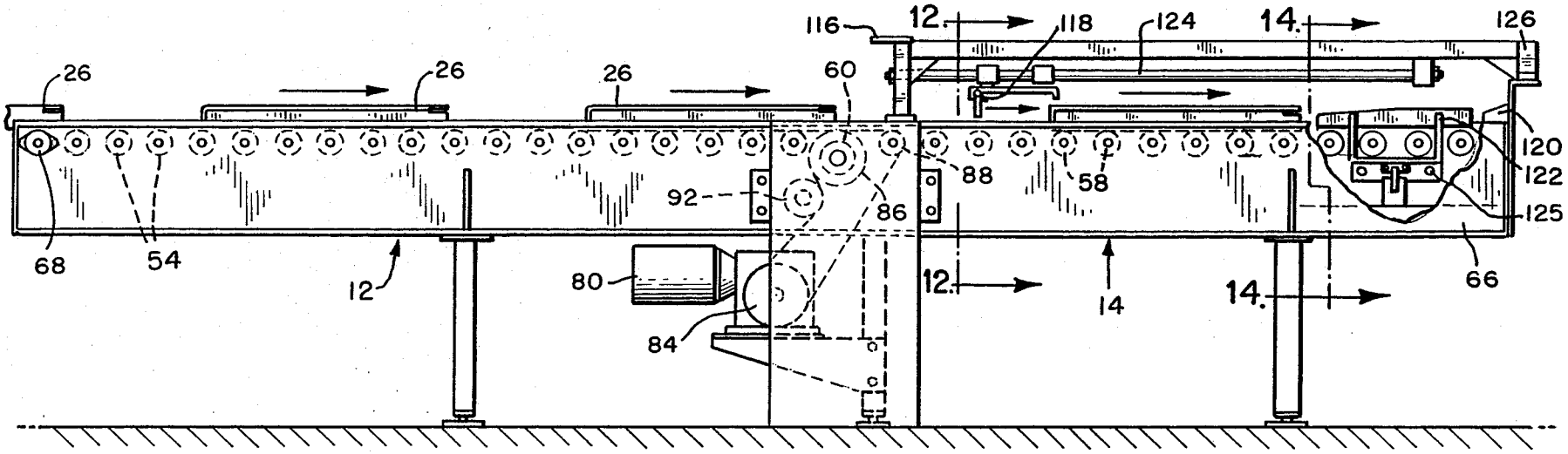
FIG. 9 is a sided view of the infeed conveyor and the first transfer section.
Figure 12:
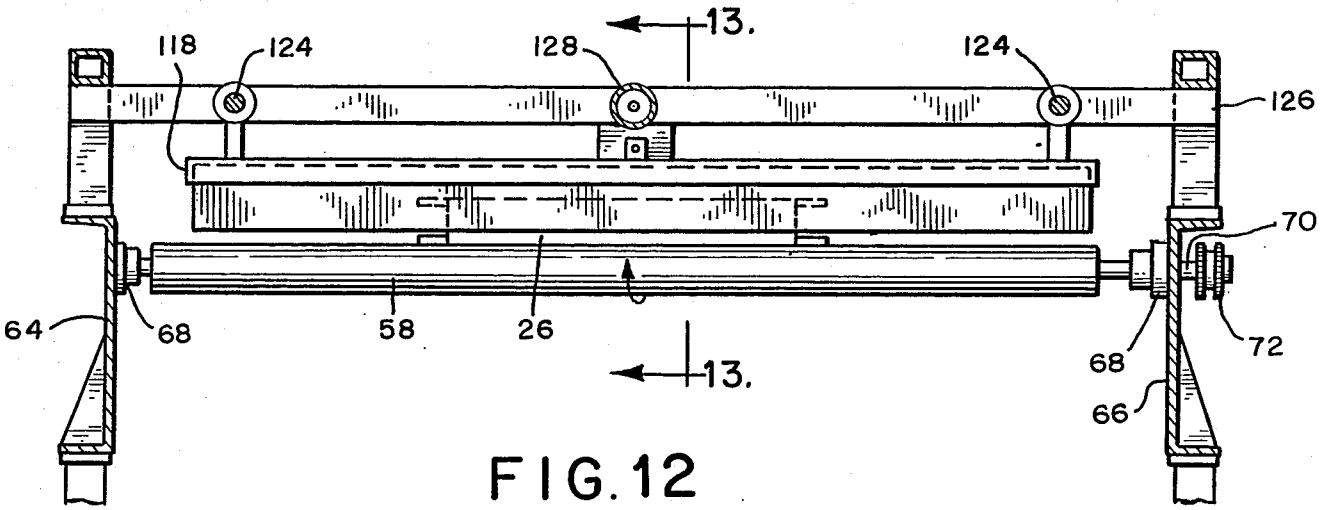
FIG. 12 is a cross-sectional view of the first transfer section taken along line 12—12 of FIG. 9.

FIG. 9 illustrates the infeed conveyor 12 and the first transfer section 14. Three cartons 26 are being conveyed on the infeed conveyor 12 and one carton 26 is being conveyed on the first transfer section 14 transfer rollers 58. There are nineteen infeed rollers 54 in the infeed conveyor 12 and fourteen transfer rollers 58 in the first transfer section 14. A feed roller 60 is located between the infeed conveyor 12 and the first transfer section 14. The infeed rollers 54 and the transfer rollers 58 have steel surfaces which contact the cartons 26 they convey. The feed roller 60 has a high friction surface 62 made of rubber or another high friction material. In addition, the feed roller 60 diameter is two times that of the infeed rollers 54 and the transfer rollers 58.

Figure 11:
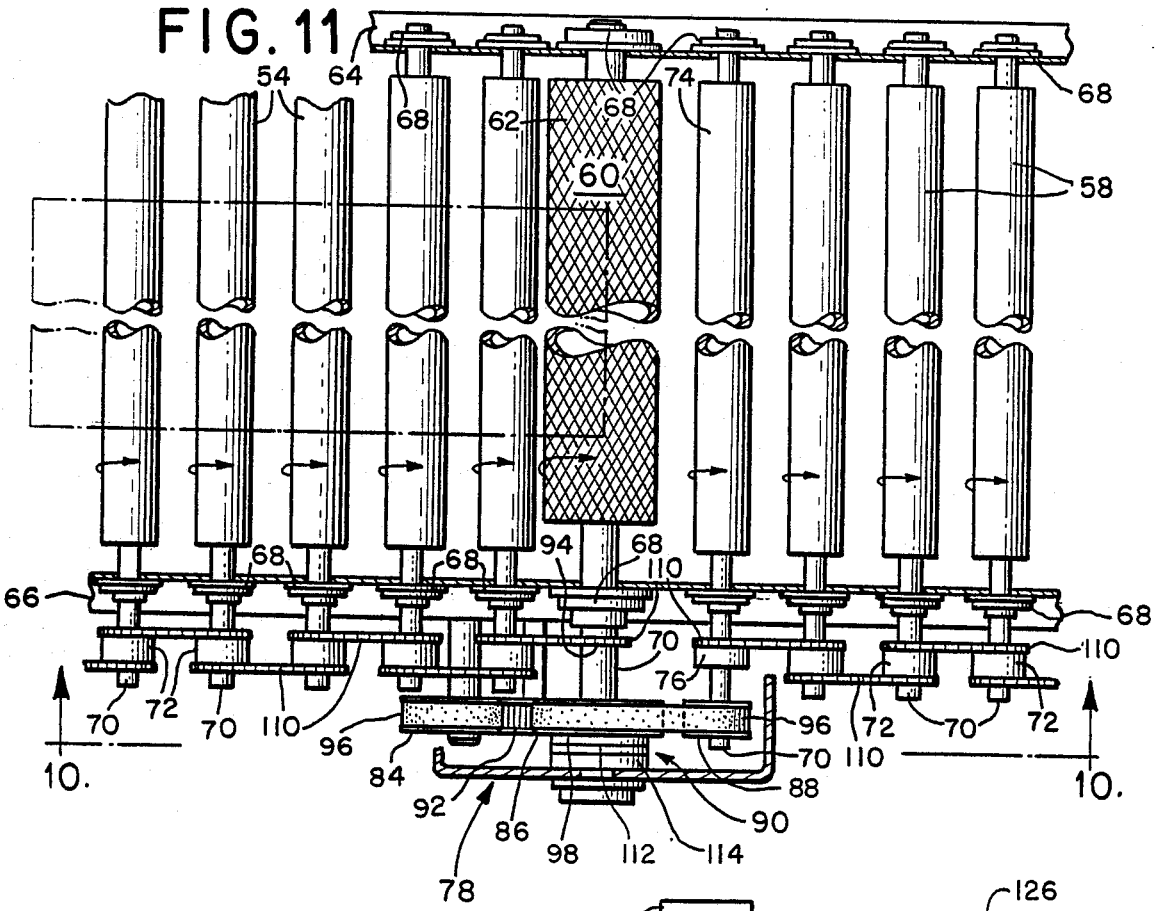
FIG. 11 is a top view of the infeed roller, feed roller and transfer roller drive means.

FIG. 11 illustrates the infeed rollers 54, transfer rollers 58 and feed roller 60 rotatively supported at each end by a first side frame 64 and a second side frame 66. Two flange bearings 68, one at each end of the rollers, are used to rotatively mount each roller to the side frames 64, 66. Each roller also includes an end shaft portion 70 which extends beyond the flange bearings 68 that are mounted to the second side frame 66. Double chain sprocket 72 is fixably attached to the end shaft portions 70 of the infeed rollers 54 and the end shaft portions 70 of all the transfer rollers 58 except the primary transfer roller 74. A single chain sprocket 76 is fixably attached to the end shaft portion 70 of the primary transfer roller 74.

Figure 10:
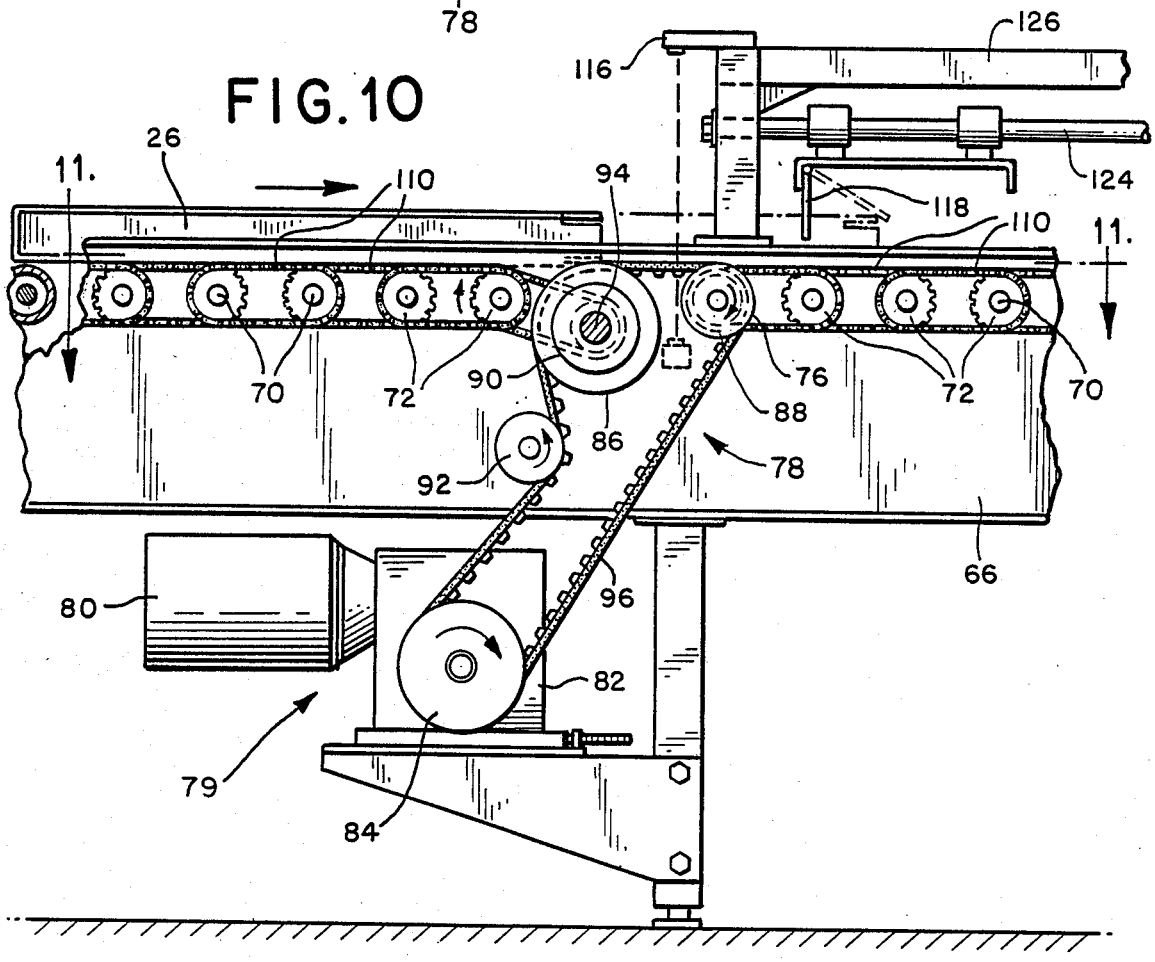
FIG. 10 is a side view of the infeed roller, feed roller and transfer roller drive means.
Figure 13:
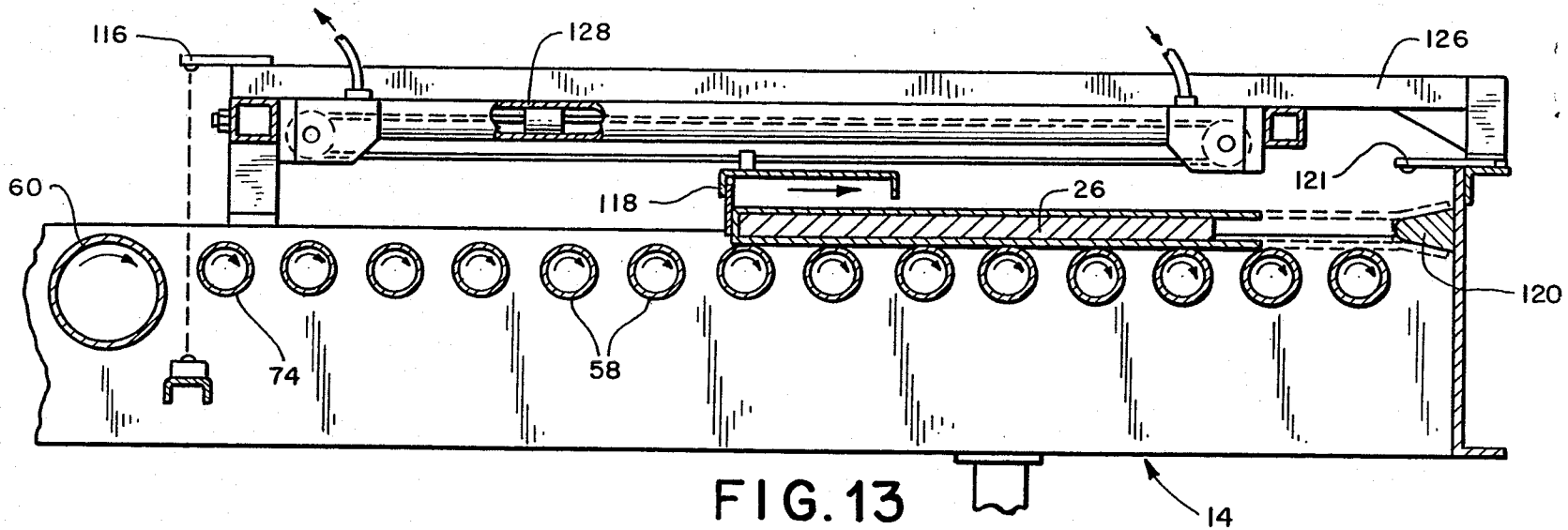
FIG. 13 is a cross-sectional view of the first transfer section taken along line 13—13 of FIG. 12.
Figure 14:
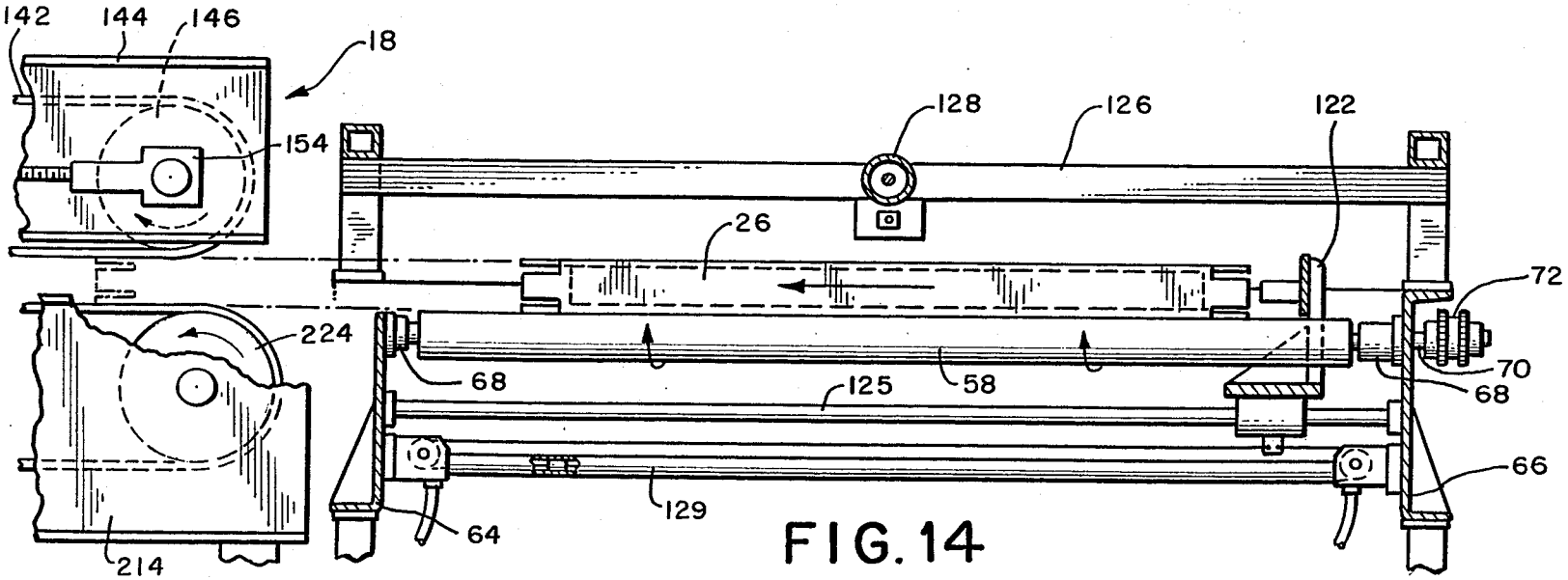
FIG. 14 is a cross-sectional view of the first transfer section taken along line 14—14 of FIG. 9.

FIGS. 10 and 11 illustrate the drive train 78 and electric motor assembly 79 for driving the infeed rollers 54, the feed roller 60 and the transfer rollers 58. The rollers are powered by a one and one-half horsepower electric drive motor 80 such that the surface speed of the infeed rollers 54 is approximately fifty feet per minute and the surface speed of the feed roller 60 and the transfer rollers 58 is approximately ninety feet per minute.

The drive train 78 includes a speed reducer 82, a drive gearbelt pulley 84, a driven gearbelt pulley 86, a gearbelt pulley 88, an electric clutch 90, a gearbelt tightener 92, a single chain sprocket 94 and a gearbelt 96. The drive gearbelt pulley 84 is fixably attached to the speed reducer 82 and drives the gearbelt 96. The gearbelt 96 drives the gearbelt pulley 88 fixably attached to the end shaft portion 70 of the primary transfer roller 74. The gearbelt 96 also drives the driven gearbelt pulley 86 which is fixably attached to the drive plate 98 of the electric clutch 90. The driven gear belt pulley 86 and the drive plate 98 of the electric clutch 90 are rotatively mounted on the shaft portion 70 of the feed roller 60 and spin freely with respect to the end shaft portion 70 when the electric clutch 90 is not activated.

The single chain sprocket 76 is fixably attached to the end shaft portion 70 of the primary transfer roller 74 and drives a roller chain 110. The roller chain 110 drives the double chain sprocket 72 on the adjacent transfer roller 58. The double chain sprocket 72 drives the transfer roller 58 and another roller chain 110 which drives the double chain sprocket 72 of the next adjacent transfer roller 58. The cooperation of the double chain sprockets 72 on the transfer rollers 58 and roller chains 110 enables all of the transfer rollers 58 to be driven from the primary transfer roller 74.

The single chain sprocket 94 and the driven plate 112 of the electric clutch 90 are fixably attached to the end shaft portion 70 of the feed roller 60. When the electric clutch 90 is activated the drive plate 98 comes into contact with the driven plate 112 of the electric clutch 90. The driven plate 112 of the electric clutch 90 drives the feed roller 60 and the single chain sprocket 94. When the electric clutch 90 is deactivated the driven plate 112 comes into contact with a brake plate 114 and the feed roller 60 and the single chain sprocket 94 are prevented from rotating.

The single chain sprocket 94 drives a roller chain 110. The roller chain 110 drives the double chain sprocket 72 on the first infeed roller 54 adjacent to the feed roller 60. The double chain sprocket 72 drives the infeed roller 54 and another roller chain 110 which drives the double chain sprocket 72 of the next adjacent infeed roller 54. The cooperation of the double chain sprockets 72 on the infeed rollers 54 and the roller chains 110 enables all of the infeed rollers 58 to be driven from the single chain sprocket 94.

The electric clutch 90 is activated by an Allen Bradley Programmable Logic Controller 205 PLC, herein after referred to as the controller (not shown). The controller monitors a photo eye 116 located between the infeed conveyor 12 and the first transfer section 14. The leading end 130 of a carton 26 and the trailing end 132 of a carton 26 trigger the photo eye 116 and cause the controller to deactivate the electric clutch 90 after the trailing end 132 triggers the photo eye 116. The controller also monitors a photo eye 117 at the inlet to the first flap folding, gluing and compressing section 18. When the leading end 130 of a carton 26 triggers this photo eye 117 the controller activates the electric clutch 90 which causes the infeed conveyor 12 and feed roller 54 to convey another carton 26 to the first transfer section 14.

The first transfer section 14 also includes a oneway pusher gate 118, a guide fence 120 and a pusher arm 122. FIGS. 9, 10, 12, 13 and 14 illustrate the one-way pusher gate 118, the guide fence 120 and the pusher arm 122.

The pusher gate 118 is guided by two guide bars 124 mounted on a pusher gate support structure 126. The pusher gate 118 is moved along the guide bars 124 by a cable cylinder 128 which is activated with air pressure. Air pressure is supplied to each side of the cable cylinder 128 and is controlled by an air valve (not shown) which is controlled by the controller. When the photo eye 116 located between the infeed conveyor 12 and the first transfer section 14 is triggered by the trailing end 132 of a carton 26, the controller activates the air valve after a predetermined period of time. The air pressure activates the cable cylinder 128 which causes the pusher gate 118 to force a conveyed carton 26 into contact with the guide fence 120. A photo eye 121 monitored by the controller is located above the guide fence 120. When this photo eye 121 is triggered by the leading end 130 of a carton 26 the controller activates the air valve and air pressure is supplied to the cable cylinder 128 so that the pusher gate 118 is returned to its initial position.

The pusher arm 122 is guided by two guide bars 125 mounted to the side frames 64, 66. The pusher arm 122 is guided along the guide fence 120 which is perpendicular to the carton 26 direction defined by the infeed rollers 54 and transfer rollers 58. The pusher arm 122 is guided along the guide bars 125 by a cable cylinder 129 which is activated with air pressure. Air pressure is supplied to each side of the cable cylinder 129 and is controlled by an air valve which is controlled by the controller. When the photo eye 121 located above the guide fence 120 is triggered by the leading end of a carton 26, the controller activates the air valve. Air pressure supplied by the air valve activates the cable cylinder 129 which causes the pusher arm 122 to force the carton 26 into the first flap folding, gluing and compressing section 18. When the photo eye 117 located at the inlet to the first flap folding, gluing and compressing section 18 is triggered by the trailing end 132 of a carton 26, the controller activates the air valve. Air pressure is supplied by the air valve to the cable cylinder 129 so that the pusher arm 122 returns to its initial position.

First, Second and Third Flap Folding, Gluing and Compressing Sections

The first flap folding, gluing and compressing section 18 is illustrated in FIGS. 15–23. The second and third flap folding, gluing and compressing sections 20, 22 are similar to the first flap folding, gluing and compressing section 18 and include a main support structure 134; an endless presser belt conveyor 136; an endless conveyor belt conveyor 138; two presser belt conveyor supports 140; and flap folding, gluing and compressing means.

The endless presser belt conveyor 136 illustrated in FIGS. 15, 16, 18 and 19 includes an endless presser belt 142, two side frames 144, two presser belt rollers 146, a three-quarter horse power electric drive motor 148, a speed reducer 150, two side frame support arms 152, two presser belt tighteners 154 and three adjustable weight floating presser plates 156.

The two side frames 144 are fixably mounted in a parallel and side-by-side relationship on the two support arms 152. The side frames 144 are spaced apart so that the presser belt rollers 146 can fit between the side frames 144. A sheetmetal presser belt support plate 158 is fixably mounted between the side frames 144. A one-half inch thick sheet of Ultra High Molecular Weight (UHMW) plastic 160 is fixably attached to the top side of the support plate 158. The plastic sheet 160 has one groove 162 extending down its length. The plastic sheet 160 defines the direction of travel for the top run 164 of the presser belt 142 and reduces friction between the top run 164 of the presser belt 142 and the presser belt support plate 158.

Three adjustable weight floating presser plates 156 are mounted between the two side frames 144. A one-half inch thick sheet of UHMW plastic 173 is fixably attached to the bottom side 175 of each presser plate 156. The plastic sheet 173 has one groove 162 extending down its center. The plastic 173 sheet defines the direction of travel for the bottom run 166 of the presser belt 142 and reduces friction between the bottom run 166 of the presser belt 142 and the floating presser plates 156. A slider bolt 168 is welded to the top side 179 of each presser plate 156 at each of its four corners. In addition, twelve presser plate weight mounting bolts 170 are welded to the top side of each presser plate 156. Two presser plate weight mounting bolts 170 serve to mount each presser plate weight 172.

Figure 15:
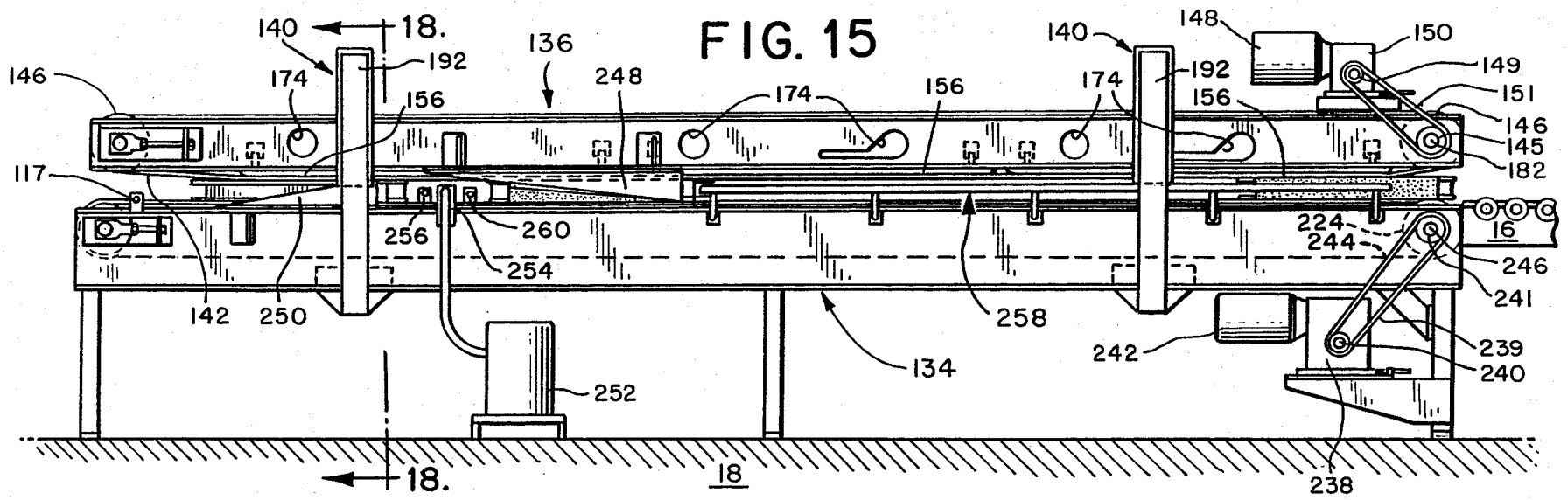
FIG. 15 is a side view of a flap folding, gluing and compressing section.
Figure 16:
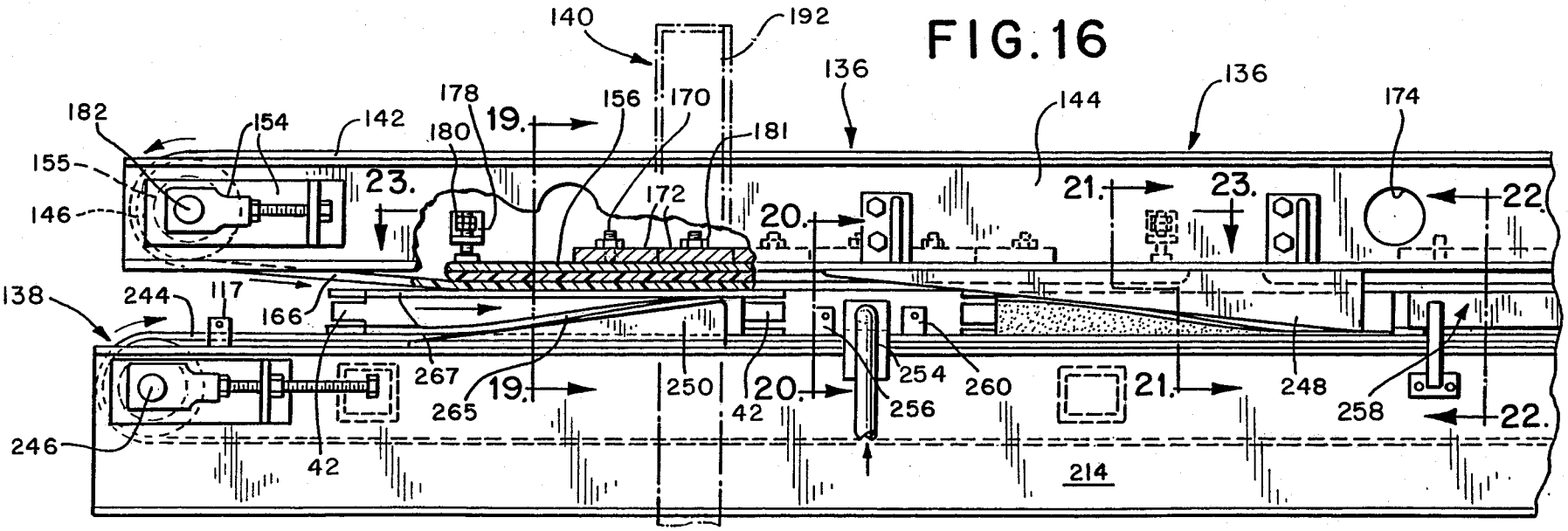
FIG. 16 is a side view of the inlet to a flap folding, gluing and compressing section.

As shown in FIGS. 15 and 16, the side frames 144 have a plurality of openings 174. These openings 174 are designed so that a presser plate weight 172 can be placed between the side frames 144 after the presser belt 142 has been mounted to the endless presser belt conveyor 136. After a presser plate weight 172 is placed between the side frames 144 the weight is moved by hand onto the presser plate weight mounting bolts 170 and fastened down with locknuts 181.

The purpose of the presser plate weights 172 is to adjust the weight of the adjustable weight floating presser plates 156 and thereby adjust the contact pressure between the bottom run 166 of the presser belt 142 and the top wall 32 of a carton 26. The weight of the adjustable weight presser plate 156 is adjusted by adding or removing presser plate weights 172 from the adjustable weight presser plate 156. The presser belt 142 and the conveyor belts 244 force cartons 26 against the flap folding, gluing and compressing means, thus the weight of the adjustable weight presser plate 156 must be adjusted so that the carton 26 does not slide relative to the surfaces of the presser belt 142 and the conveyor belts 244. In addition, the presser plate 156 weight must be adjusted so that the force between the carton 26 and the presser belt 142 is not so high that it crushes the carton 26 and/or the contents of the carton 26.

Twelve slider bolt guides 176 are welded to the interior sides of the side frames 144. The slider bolt guides 176 are spaced so that each of the four slider bolts 168 on each of the three floating presser plates 156 will slide into one slider bolt guide 176. After the slider bolts 168 are in there appropriate bolt guides 176 a nut 178 and a jam nut 180 are turned onto the slider bolts 168 to prevent the slider bolts 168 from sliding out of the slider bolt guides 176. The nut 178 and the jam nut 180 should be adjusted to allow the slider bolts 168 to translate within the slider bolt guides 176 for a distance of about one inch. The translation of the slider bolts 168 allows the floating presser plates 156 to float and thereby force the bottom run 166 of the presser belt 142 down onto a carton 26.

Each of the two presser belt rollers 146 is rotatively mounted between the side frames 144 and at one end of the side frames 144. The presser belt rollers 146 are mounted on roller shafts 182 which are rotatively mounted to the side frames 144 with flange bearings (not shown). The roller shaft 182 of one of the presser belt rollers 146 is rotatively mounted with bearings 155 mounted on presser belt tighteners 154. The presser belt tighteners 154 are mounted to the side frames 144 so that the distance between the presser belt rollers 146 can be changed. The tension in the presser belt 142 is changed by changing the distance between the presser belt rollers 146.

The presser belt 142 is a polyester backed belt with a rough top rubber surface 184. The polyester backing decreases the friction between the inside surface of the presser belt 142 and the UHMW plastic sheets 160, 173 on the presser belt support plates 158 and the floating presser plates 156. The rough top rubber surface 184 of the belt increases the friction between the outside surface 184 of the presser belt 142 and the cartons 26 conveyed between the presser belt 142 and the conveyor belts 244. The presser belt 142 is supported by and travels along the outside surfaces of the presser belt rollers 146, the presser belt support plate 158 and the floating presser plates 156.

An endless "V" belt 186 is vulcanized to the inside surface of the presser belt 142. The "V" belt 186 rides in; the grooves 162 of the UHMW plastic sheets 160, 173 on the presser belt support plate 158, and the floating presser plates 156, and the grooves (not shown) of the presser belt rollers 146. The cooperation between the "V" belt 186 and the grooves 162 prevent the presser belt 142 from moving perpendicular to its direction of travel along the presser belt rollers 146, the presser belt support plate 158 and the floating presser plates 156.

FIG. 15 illustrates the drive for the endless presser belt 142. A three-quarter horsepower electric motor 148 drives a speed reducer 150 which drives a gearbelt pulley 149. The gearbelt pulley 149 drives a gearbelt 151 which drives a second gearbelt pulley 145 fixably attached to the presser belt roller shaft 182. The endless presser belt 142 is driven along its path of travel by the presser belt roller driven 146 by the presser belt roller shaft 182.

Figure 18:
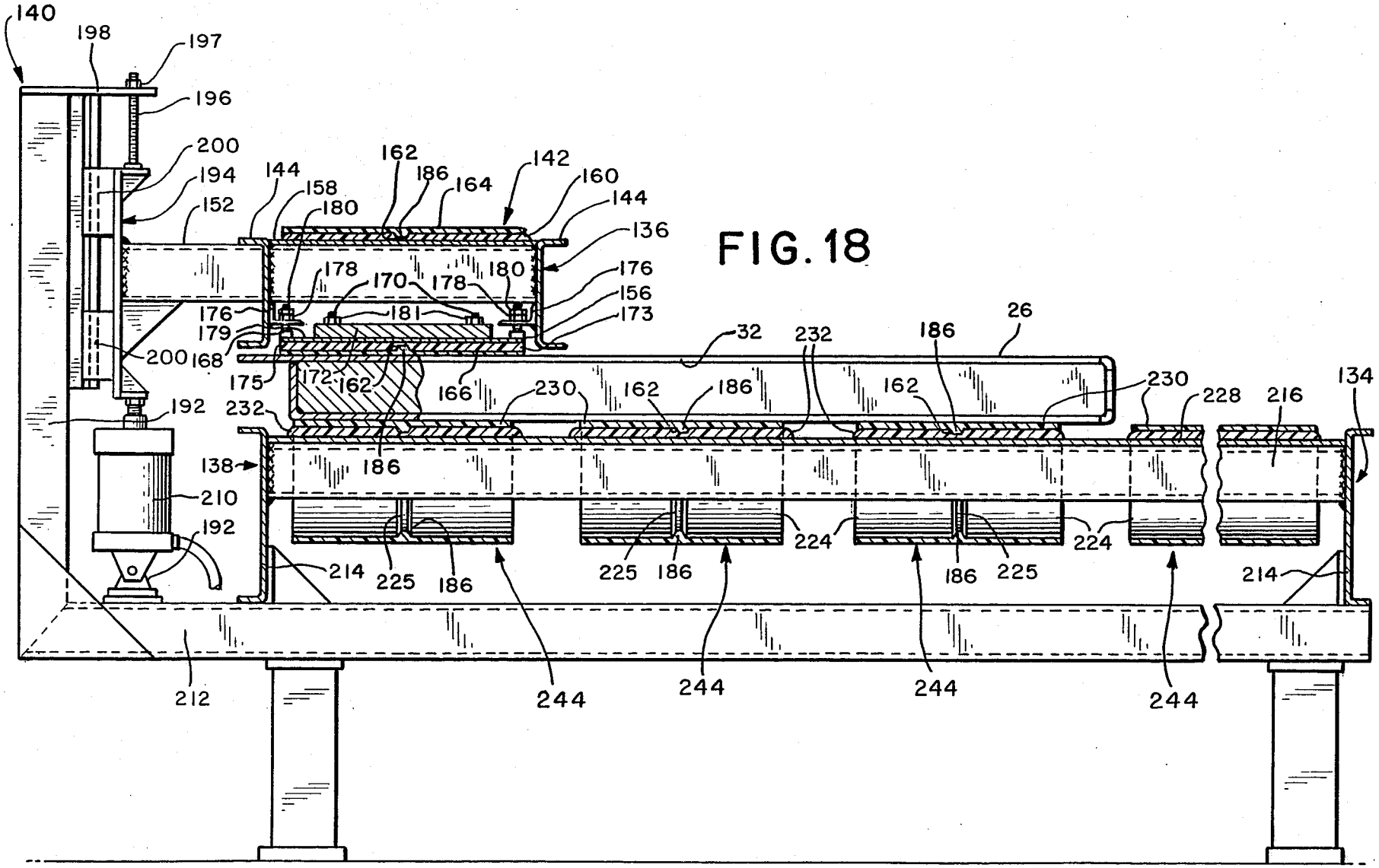
FIG. 18 is a cross-sectional view of a flap folding, gluing and compressing section taken along line 18—18 of FIG. 15.
Figure 19:
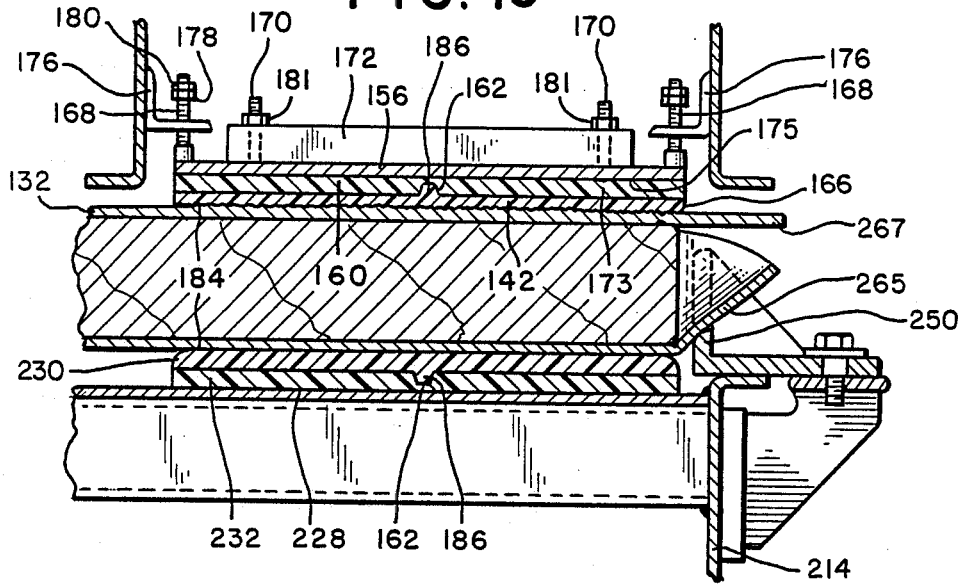
FIG. 19 is a cross-sectional view of a flap folding, gluing and compressing section taken along line 19—19 of FIG. 16.
Figure 20:
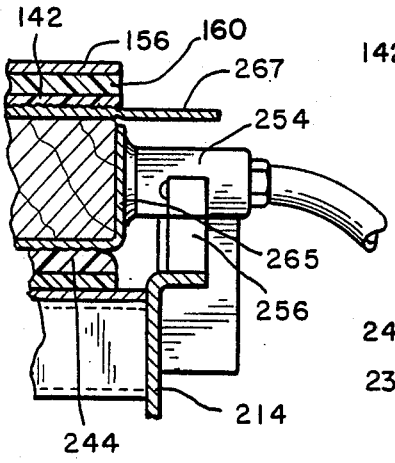
FIG. 20 is a cross-sectional view taken along line 20—20 of FIG. 16.
Figure 21:
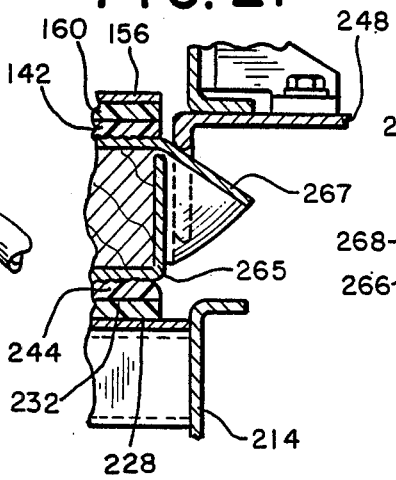
FIG. 21 is a cross-sectional view taken along line 21—21 of FIG. 16.

Each support arm 152 of the endless presser belt conveyor 136 is fixably attached to a presser belt conveyor support 140. FIG. 18 illustrates the supports 140. The supports 140 are designed to support the presser belt conveyor 136 above the conveyor belt conveyor 138 and to change the distance between the presser belt 142 and the conveyor belts 244. In addition, the support arms 152 are designed to locate the endless presser belt 142 directly above the first of four endless conveyor belts 244. (See FIG. 18) The supports 140 include a main column 192, a translating frame 194, a threaded height adjustment rod 196, a translating frame hanger 198, two linear bearings 200 and an air cylinder 210.

Each support arm 152 is welded to a translating frame 194. The translating frames 194 each translate vertically along two linear bearings 200 which are fixably mounted to the main column 192. The air cylinders 210 are pivotally mounted to the support beams 212 and fixably mounted to the bases of the translating frames 194. The air cylinders 210 can be used to cause the translating frames 194 to translate vertically along the main column 192. Threaded height adjustment rods 196 are fixably attached to the tops of the translating frames 194 and pass through holes in the translating frame hangers 198. The translating frames 194 can also be caused to translate by either tightening a nut 197 on the adjustment rod 196 against the translating frame hanger 198 or loosening the nut 197. The main column 192 of the supports 140 are fixably attached to the main support structure 134 of the flap folding, gluing and compressing sections 18, 20, 22 with support beams 212.

Figure 17:
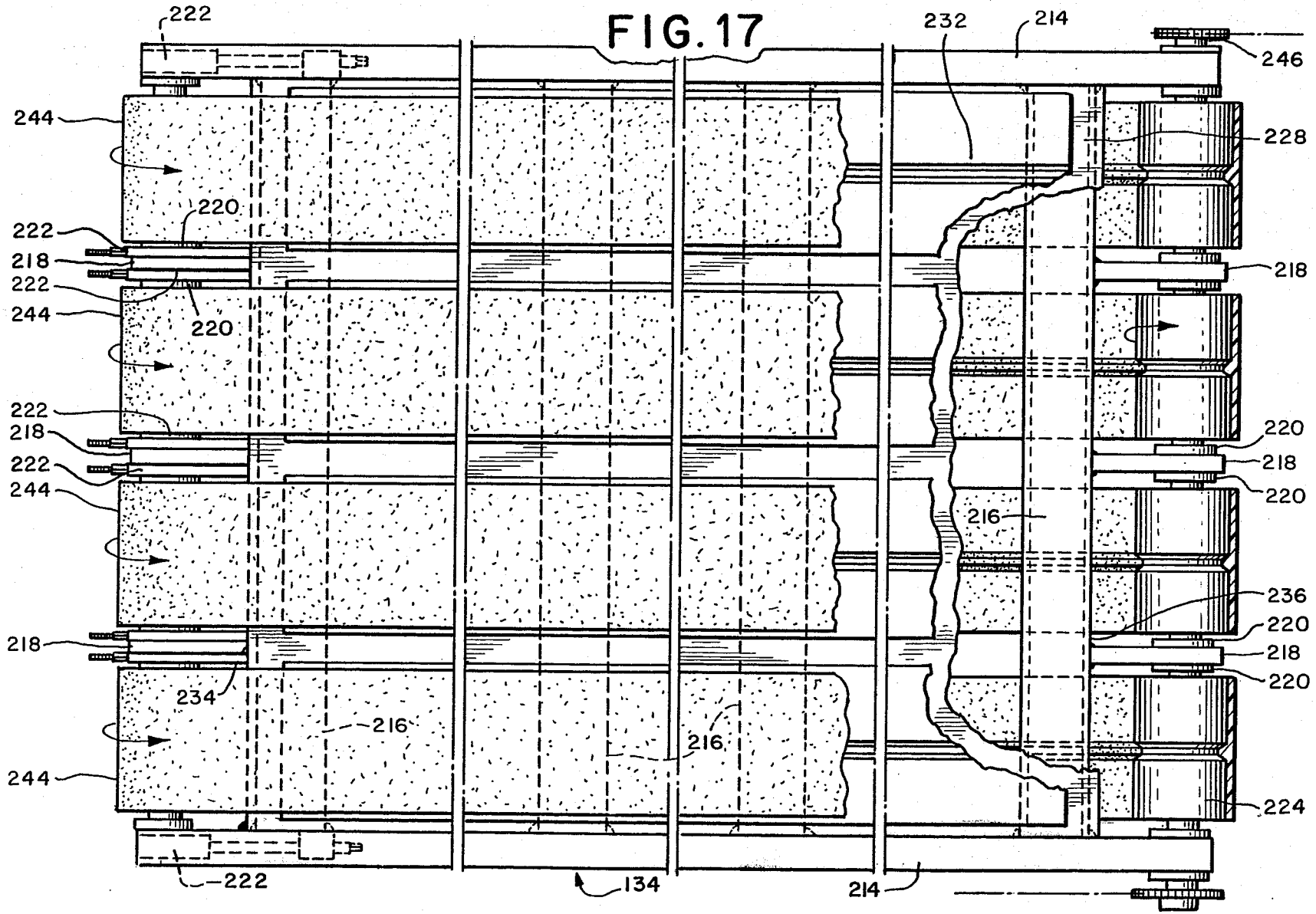
FIG. 17 is a top view of a conveyor belt support structure.

The main support structure 134 illustrated in FIGS. 15, 17 and 18 includes two main side frames 214 fixably mounted in a parallel side by side relationship by four main support beams 216. The support beams 216 are welded between the side frames 214. At the first end of the main support structure 134 three vertical support plates 218 are welded to the end face of the first main support beam 234 which is nearest the first end of the main support structure 134. The three vertical support plates 218 are designed to support one conveyor belt roller bearing 220 and one conveyor belt tightener 222 on each of its two sides. At the second end of the main support structure three vertical support plates 218 are welded to the end face of last main support beam 236 which is nearest the second end of the main support structure 134. The three vertical support plates 218 are designed to support one conveyor belt roller bearing 220 on each of its two sides.

Four conveyor belt rollers 224 are supported at the first end of the main support structure 134. Each of the conveyor belt roller shafts 246 is supported by two bearings 220. The bearings 220 are supported by the conveyor belt tighteners 222. As illustrated in FIGS. 16 and 17 the two bearings 220 and the two conveyor belt tighteners 222 nearest the outside sides of the main support structure 134 are supported by the main side frames 214. The other six bearings 220 and conveyor belt tighteners 222 are supported by the three vertical support plates 218. In addition, four conveyor belt rollers 224 are supported at the second end of the main support structure 134. The conveyor belt roller shaft 246 is supported by two conveyor belt roller bearings 224. The two bearings 220 nearest the outside sides of the main support structure 134 are supported by the main side frames 214. The other six bearings 224 are supported by the three vertical support plates 218.

A sheetmetal top run support plate 228 is welded to the four main support beams 216 and the two main side frames 214. The support plate 228 supports the top runs 230 of the endless conveyor belts 244. Four one-half inch thick sheet of UHMW plastic 232 one inch wider than the conveyor belts 244 are fixably attached to the top side of the support plate 228. The plastic sheets 232 run between the first main support beam 234 and the last main support beam 236. The plastic sheets 232 each have one groove 162 extending down their lengths. The plastic sheet 232 defines the direction of travel for the top run 230 of each conveyor belt 244 and reduces friction between the top run 230 of each conveyor belt 244 and the conveyor belt support plate 228.

The four endless conveyor belts 244 are polyester backed belts with a rough top rubber surface 184. The polyester backing decreases the friction between the inside surface of the conveyor belts 244 and the UHMW plastic sheets 232 on the top run support plate 228 for the conveyor belts 244. The rough top rubber surface 184 of the belts 244 increases the friction between the outside surface of the conveyor belts 244 and the cartons 26 conveyed between the presser belt 142 and the conveyor belts 244. The conveyor belt 244 is supported by and travels along the outside surfaces of the conveyor belt rollers 224 and the top run support plate 228.

An endless "V" belt 186 is vulcanized to the inside surface of the conveyor belts 244. The belts 186 ride in the grooves 162 of the UHMW plastic sheets 232 on the top run support plate 228 and the grooves 225 in the conveyor belt rollers 224. The cooperation between the "V" belt 186 and the grooves 162 prevents the conveyor belts 244 from moving perpendicular to their direction of travel along the top run support plate 228 and the conveyor belt rollers 224.

FIG. 15 illustrates the drive for the endless conveyor belt 244. A one and one-half horsepower electric motor 242 drives a speed reducer 238 which drives a gearbelt pulley 240. The gearbelt pulley 240 drives a gearbelt 239 which drives a second gearbelt pulley 241 which is fixably attached to the conveyor belt roller shaft 246. The endless conveyor belt 244 is driven along its path of travel defined by the conveyor belt roller 224 which is driven by the conveyor belt roller shaft 246.

The speed reduction ratio in the speed reducers 238 on the three flap folding, gluing and compressing sections 18, 20, 22 is the same. The ratio of teeth on the gearbelt pulleys 240, 241 is designed to allow the conveyor belts 244 on the first and third flap folding, gluing and compressing sections 18, 22 to move at a surface speed of sixty feet per minute and the conveyor belts 244 on the second flap folding, gluing and compressing section 20 to move at a surface speed of seventy five feet per minute.

The three flap folding, gluing and compressing sections 18, 20, 22 also include a top flap plow 248, a bottom flap plow 250, a glue supply unit 252, a glue applicator head 254, two photo eyes 256, 260 and compressing unit 258. FIG. 16 illustrates the relation ship of these components.

The bottom flap plow 250 is bolted to the top edge of the main support structure side frame 214 which is nearest to the presser belt conveyor supports 140. The top flap plow 248 is bolted to the bottom edge of the presser belt conveyor side frame 144 which is nearest to the presser belt conveyor supports 140. The bottom flap plow 250 and the top flap plow 248 are oriented on the side frames 144, 214 so that the bottom flap 265 of a carton 26 is folded before the top flap 267. This orientation is shown in FIG. 16.

The glue applicator head 254 is bolted to the top edge of the main support structure side frame 214 which is nearest to the presser belt conveyor supports 140. The glue applicator head 254 is located below the top flap plow 248 so that glue is applied to the folded bottom flap 265 just before the top flap 267 is folded onto the bottom flap 265. In addition, the glue head 254 should be located so that there is a gap between the glue head 254 and the folded bottom flap 265 of about one-quarter of an inch.

Photo eyes 256, 260 are mounted on each side of the glue applicator head 254. Both of these photo eyes 256, 260 are monitored by the controller. When the second photo eye 260 located along the direction of travel for a carton 26 senses the leading side 362 of a carton 26 the controller activates the glue supply unit 252 which supplies glue to the glue applicator head 254. When the first photo eye 256 located along the direction of carton 26 travel senses the trailing side 364 of a carton 26 the controller deactivates the glue supply unit 252. This arrangement for the photo eyes 256, 260 prevents glue from being supplied to the glue applicator head 254 when a carton 26 flap is not in front of the glue applicator head 254.

Figure 22:
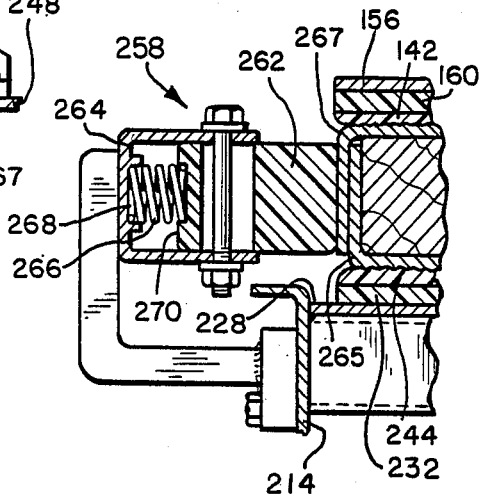
FIG. 22 is a cross-sectional view taken along line 22—22 of FIG. 16.
Figure 23:
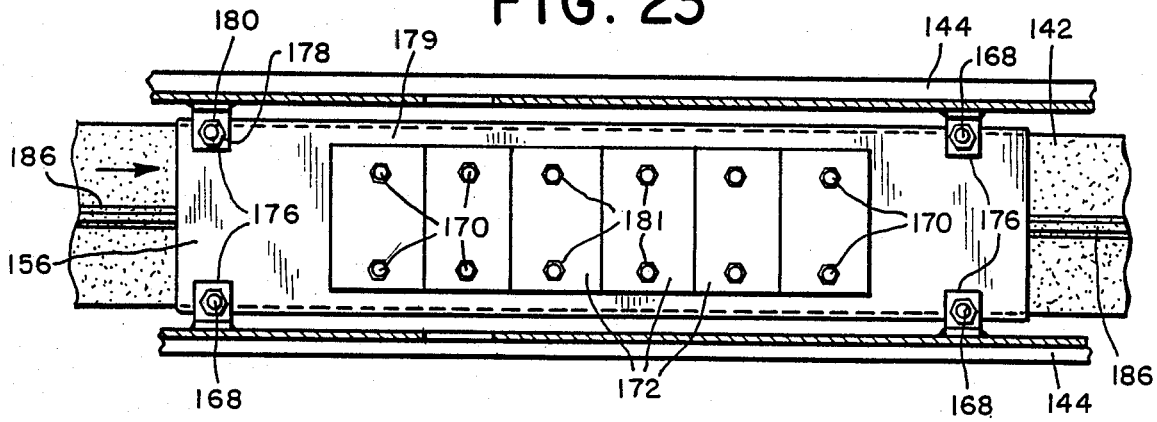
FIG. 23 is a cross-sectional view taken along line 23—23 of FIG. 16.

The compressing unit 258, shown in FIG. 15, 16 and 22, holds the top flap 267 against the bottom flap 265 until the glue between the two flaps 265, 267 is set. The compressing unit 258 is bolted to the main support structure side frame 214 and is oriented with respect to the top flap plow 248 so that the compressing unit 258 engages the top flap 267 after it has been folded. The compressing unit 258 includes a UHMW plastic slide rail 262 which is supported by a channel 264. The slide rail 262 is held against the folded flaps of a carton 26 by a plurality of springs 266 mounted between the rear wall 268 of the channel 264 and the inside surface 270 of the slide rail 262.

The second flap folding and compressing section 20 is the mirror image of the first and third flap folding, gluing and compressing sections 18, 22.

Second Transfer Section

Figure 24:
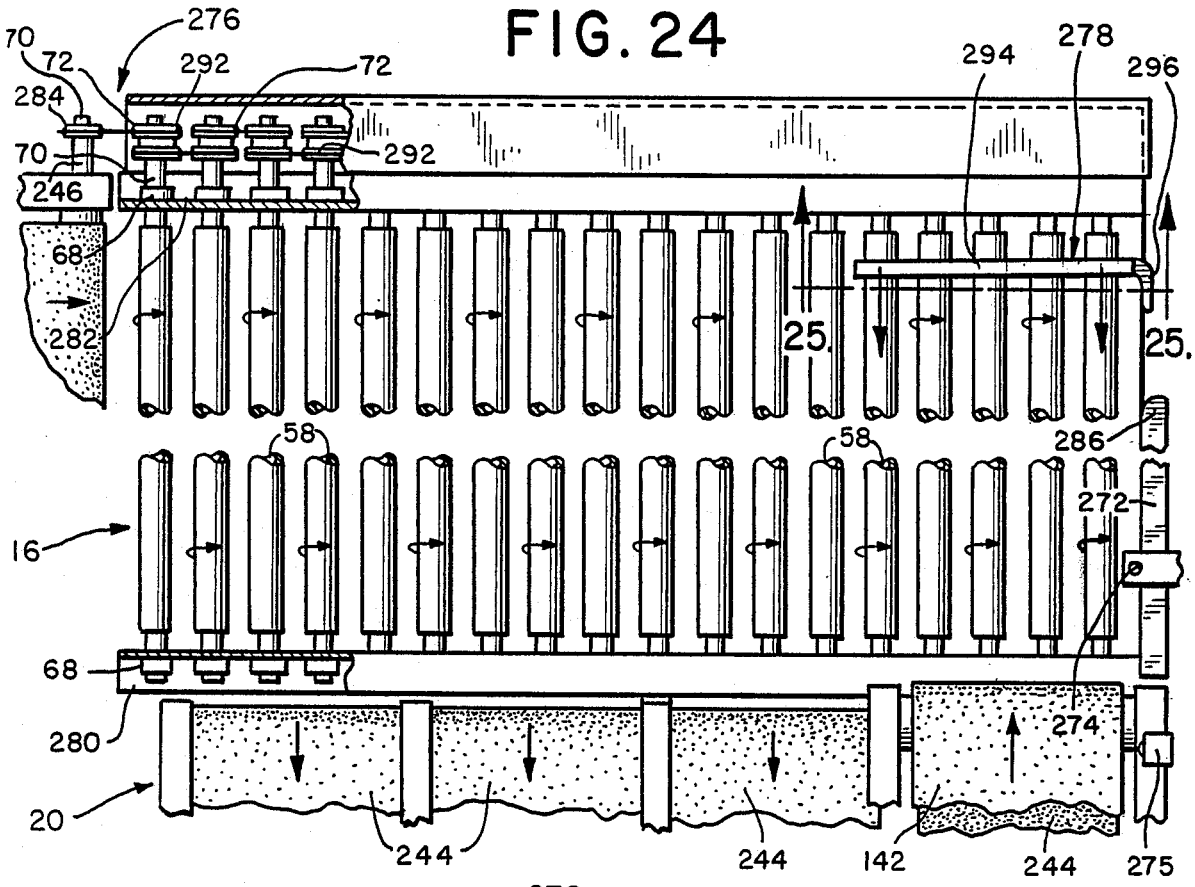
FIG. 24 is a top view of the second transfer section.
Figure 25:
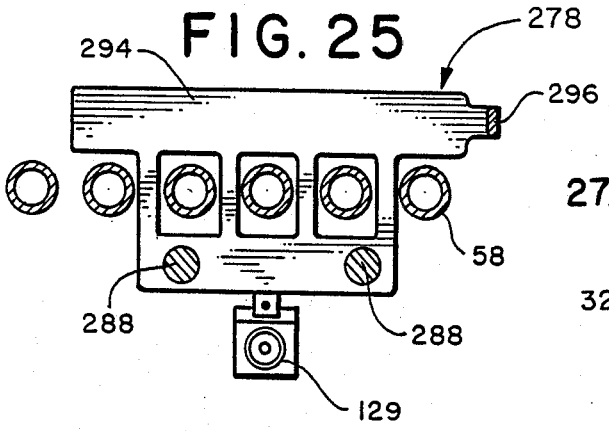
FIG. 25 is a cross-sectional view taken along line 25—25 of FIG. 24.
Figure 26:
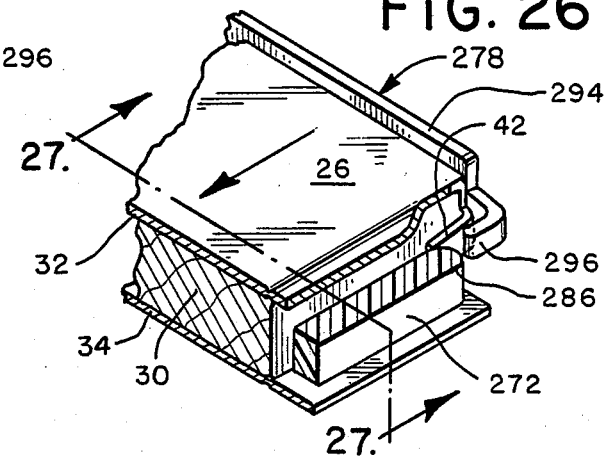
FIG. 26 is a perspective view of the pusher arm of the second transfer section, the first minor flap plow and the corner portion of a carton.
Figure 27:
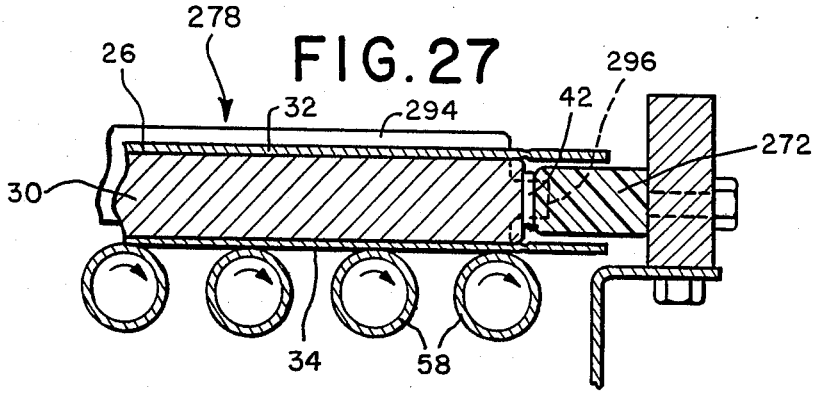
FIG. 27 is a cross-sectional view taken along line 27—27 of FIG. 26.

The second transfer section 16, shown in FIG. 24, includes eighteen transfer rollers 58, a guide fence 272, a photo eye 274, a drive train 276 and a pusher arm 278.

FIG. 24 shows the transfer rollers 58 rotatively supported at each end by a first side frame 280 and a second side frame 282. Two flange bearings 68, one at each end of the transfer rollers 58, are used to rotatively mount each transfer roller 58 to the side frames 280, 282. Each transfer roller 58 also includes an end shaft portion 70 which extends beyond the flange bearings 68 mounted to the second side frame 282. A double chain sprocket 72 is fixably attached to the end shaft portions 70 of each transfer roller 58.

A single chain sprocket 284, fixably attached to an end shaft portion 70 of the conveyor belt roller shaft 246 adjacent to the second transfer section 16, drives a first roller chain 292. The first roller chain 292 drives the double chain sprocket 72 on the transfer roller 58 adjacent to the conveyor belt roller shaft 246. The double chain sprocket 72 drives the transfer roller 58 and a second roller chain 292 which drives the double chain sprocket 72 of the next adjacent transfer roller 58. This cooperation of the double chain sprockets 72 on the transfer rollers 58 and roller chains 292 enables all of the transfer rollers 58 to be driven from the conveyor belt roller shaft 246. The number of teeth on the single chain sprocket 284 and the double chain sprockets 72 are designed so that the transfer rollers 58 will run at a surface speed of sixty feet per minute.

The guide fence 272 is located at the end of the transfer section 16 opposite to the end of the transfer section 16 which is adjacent to the first flap folding, gluing and closing section 18. The guide fence 272 is parallel to the transfer rollers 58 in the transfer section 16 and perpendicular to the carton 26 travel direction. The guide fence 272 is different from the guide fence 120 on the first transfer section 14 in that it includes a minor flap closing plow 286 for closing the first minor flap 42 on a carton 26.

The pusher arm 278 is located on the same end of the transfer section 16 as the guide fence 272. The portion of the pusher arm 278 that contacts a carton 26 is "L"

shaped. The first leg 294 of the pusher arm 278 contacts the carton 26 and the second leg 296 of the pusher arm 278 serves to fold the first minor flap 42 of a carton 26 before the minor flap 42 comes into contact with the minor flap plow 286 on the guide fence 272.

The pusher arm 278 is guided along the guide fence 272 by two guide bars 288 mounted to the side frames 280, 282. The pusher arm 278 is moved along the guide bars 288 by a cable cylinder 129 which is activated with air pressure. Air pressure is supplied to each side of the cable cylinder 129 and is controlled by an air valve (not shown) which is controlled by the controller. When the photo eye 274, which is located above the guide fence 272, is triggered by the leading side of a carton 26 the controller activates the air valve. Air pressure supplied by the air valve activates the cable cylinder 129 which causes the pusher arm 278 to fold the first minor flap and force the carton 26 into the second flap folding, gluing and compressing section 20. When the photo eye 275 located at the inlet to the second flap folding, gluing and compressing section 20 is triggered by the leading end 130 of a carton 26, the controller activates the air valve. Air pressure is supplied by the air valve to the cable cylinder 129 such that the pusher arm 278 returns to its initial position.

Third Transfer Section

Figure 28:
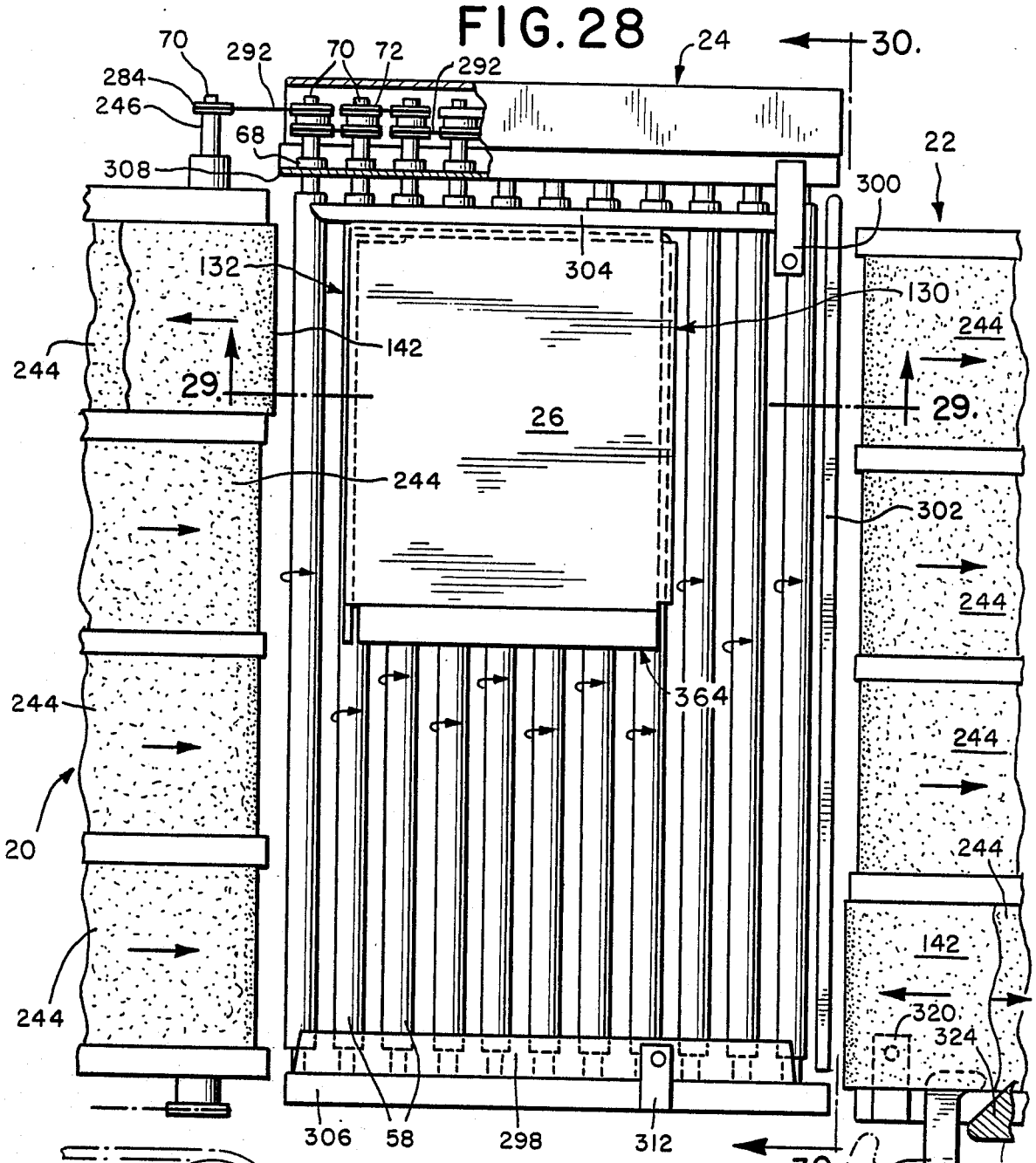
FIG. 28 is a top view of the third transfer section.
Figure 29:
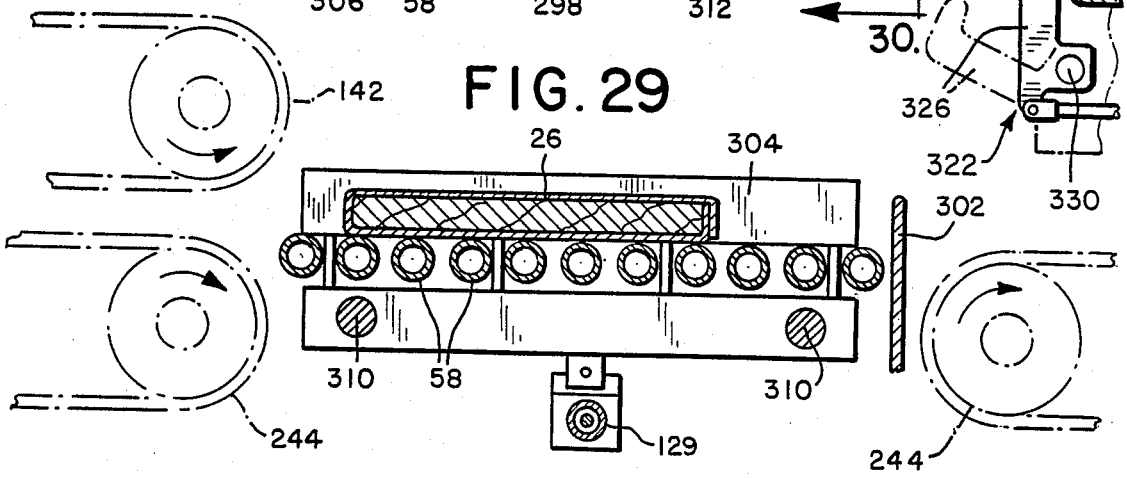
FIG. 29 is a cross-sectional view taken along line 29—29 of FIG. 28.

The third transfer section 24, shown in FIGS. 28 and 29, includes eleven transfer rollers 58, a guide fence 298, a photo eye 300, a rising stop gate 302 and a pusher arm 304.

FIG. 28 shows the transfer rollers 58 rotatively supported at each end by a first side frame 306 and a second side frame 308. Two flange bearings 68, one at each end of the transfer rollers 58, are used to rotatively mount each transfer roller 58 to the side frames 306, 308. Each transfer roller 58 also includes an end shaft portion 70 which extends beyond the flange bearings 68 mounted to the second side frame 308. A double chain sprocket 72 is fixably attached to the end shaft portions 70 of each transfer roller 58.

A single chain sprocket 284, fixably attached to an end shaft portion 70 of the conveyor belt roller shaft 246 adjacent to the third transfer section 24, drives a first roller chain 292. This roller chain 292 drives a double chain sprocket 72 on the transfer roller 58 adjacent to the conveyor belt roller shaft 246. The double chain sprocket 72 drives the transfer roller 58 and a second roller chain 292 which drives the double chain sprocket 72 of the next adjacent transfer roller 58. This cooperation of the double chain sprockets 72 on the transfer rollers 58 and roller chains 292 enables all of the transfer rollers 58 to be driven from the conveyor belt roller shaft 246. The number of teeth on the single chain sprocket 284 and the double chain sprockets 72 are designed such that the transfer rollers 58 will run at a surface speed of seventy-five per minute.

The guide fence 298 is located along side of the third transfer section 24 on the side opposite to the carton 26 flaps folded and glued in the second flap folding, gluing and compressing section 20. The guide fence 298 is perpendicular to the transfer rollers 58 in the third transfer section 24 and parallel to the carton 26 travel direction.

A photo eye 312 is located above the guide fence 298 and is monitored by the controller.

The pusher arm 304 is parallel to the guide fence 298 and located on the side of the transfer section 24 opposite the guide fence 298 and is guided along the transfer rollers 58 by two guide bars 310 mounted to the side frames 306, 308. The pusher arm 304 is moved along the guide bars 310 by a cable cylinder 129 which is activated with air pressure. Air pressure is supplied to each side of the cable cylinder 129 and is controlled by an air valve (not shown) which is controlled by the controller. When the photo eye 300, which is located above the pusher arm 304 near the rising stop gate 302, is triggered by the leading end 130 of a carton 26 the controller activates the air valve. Air pressure supplied by the air valve activates the cable cylinder 129 which causes the pusher arm 304 to force the carton 26 into the guide fence 298. When the photo eye 312 located above the guide fence 298 is triggered by the leading side 364 of a carton 26, the controller activates the air valve. Air pressure supplied by the air valve to the cable cylinder 129 such that the pusher arm 304 returns to its initial position.

Figure 30:
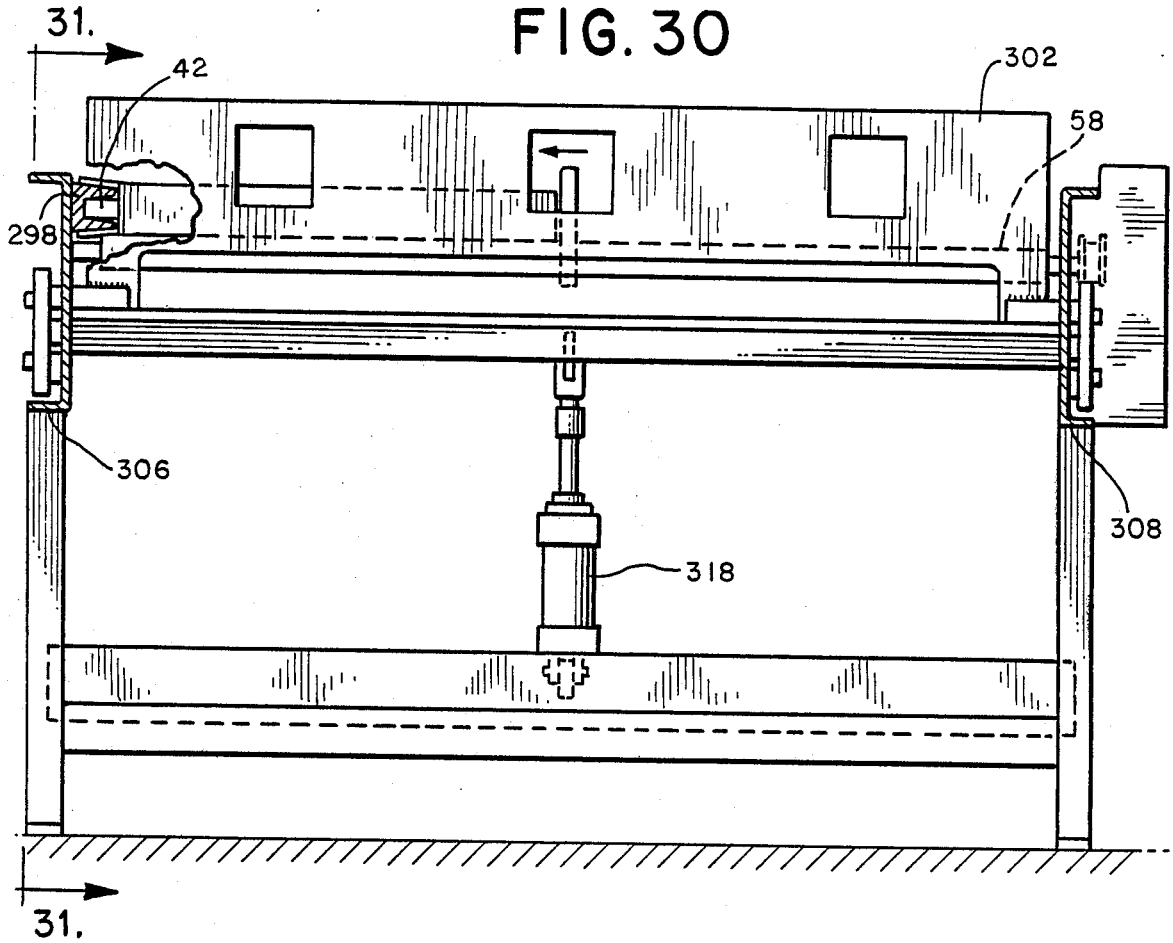
FIG. 30 is an end view of the third transfer section taken along line 30—30 of FIG. 28.
Figure 31:
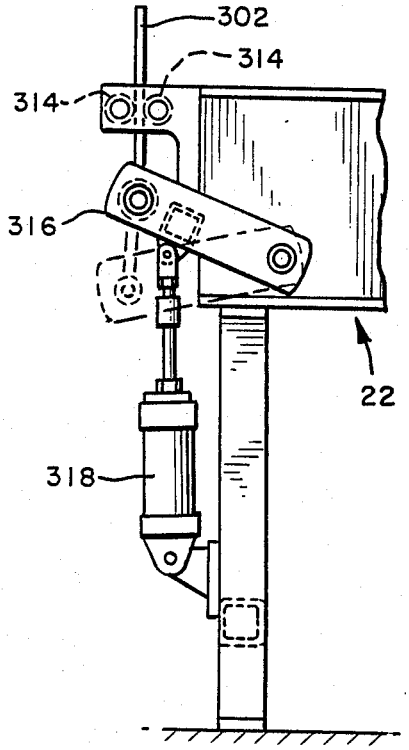
FIG. 31 is a side view of the rising stop gate taken along line 31—31 of FIG. 30.

The rising stop gate 302, illustrated in FIGS. 30 and 31, is located on the third transfer section 24 between the third transfer section 24 and the third flap folding, gluing and compressing section 22. The rising stop gate 302 is supported by a plurality of rollers 314 and a swing arm 316. The rising stop gate 302 is raised and lowered by an air cylinder 318. Air pressure is supplied to both sides of the air cylinder 318 and is controlled by an air valve (not shown) which is controlled by the controller. When the photo eye 312 located above the guide fence 298 is triggered by the leading side 362 of a carton 26, the controller activates the air valve so that pressure is supplied to the air cylinder 318 so that the air cylinder 318 lowers the rising stop gate 302. When the rising stop gate 302 is lowered a carton 26 can pass into the third flap folding, gluing and compressing section 22. A photo eye 320 located at the inlet to the third flap folding, gluing and compressing section 22 is monitored by the controller. When this photo eye 320 is triggered by the trailing end of a carton 26 the controller activates the air valve so that air pressure is supplied to the air cylinder 318 so that the air cylinder 318 raises the rising stop gate 302.

Minor Flap Tucker and Minor Flap Plow

Figure 32:
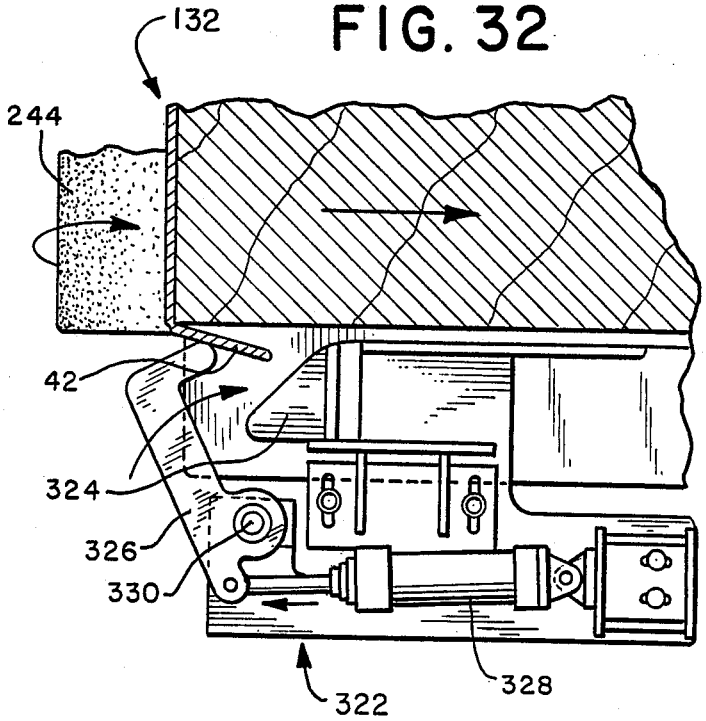
FIG. 32 is a top view of the minor flap tucker, the second minor flap plow and a corner portion of a carton.

A minor flap tucker 322 and a minor flap plow 324, illustrated in FIG. 32, are located at the inlet to the third flap folding, gluing and compressing section 22. The minor flap tucker 322 includes a tucker arm 326, an air cylinder 328 and a tucker arm pivot 330. The photo eye 320 located at the inlet to the third flap folding, gluing and compressing section 22 is monitored by the controller. Air pressure is supplied to both sides of the air cylinder 328 and is controlled by an air valve which is controlled by the controller. When the trailing end 132 of a carton 26 triggers the photo eye 320 the controller activates an air valve after a predetermined time delay. The time delay serves to activate the air cylinder 328 so that the tucker arm 326 can fold the second minor flap 42 of a carton 26 while the carton 26 is moving into the third flap folding, gluing and compressing section 22. The minor flap plow 324 serves to complete the folding of the second minor flap 42 after the flap has been partially folded by the tucker arm 326. The tucker arm 326 is returned to its initial position by the air cylinder 328.

Outfeed Section

The outfeed section 334, illustrated in FIG. 2, includes fourteen outfeed rollers 332 and a photo eye (not shown). The outfeed rollers 332 are rotatively supported at each end by a first side frame 336 and a second side frame 338. Two flange bearings 68, one at each end of the outfeed roller 332, are used to rotatively mount each roller to the side frames 336, 338. The photo eye is located above a carton stop (not shown) which is at the end of the outfeed section. The photo eye is monitored by the controller and is triggered when a carton 26 is near the carton stop. When the photo eye is triggered the controller waits for a predetermined amount of time and turns off the entire random size carton sealing machine if the carton 26 is not removed from the outfeed section 334.

Assembly of the Sections

FIGS. 1 and 2 illustrate the physical relationship of all of the sections of the preferred embodiment of the random size carton sealer 10. The random size carton sealer 10 is set up to form a first leg 340, a second leg 342 and a third leg 344. The first leg 340 and third leg 344 are parallel and the second leg 342 is perpendicular to the first leg 340 and third leg 344. The first leg 340 includes an assembly table 52 fastened to the infeed conveyor 12 and the first transfer section 14. The second leg 342 includes the first flap folding, gluing and compressing section 18 fastened to the second transfer section 16. The first end 346 of the first flap folding, gluing and compressing section 18 is fastened to the first side frame 64 of the first transfer section 14; and the first side frame 280 of the second transfer section 16 is fastened to the first end 348 of the second flap folding, gluing and compressing section 20. The second leg 342 includes the second flap folding, gluing and compressing section 20; the third transfer section 24; the third flap folding, gluing and compressing section 22 and the outfeed section 334. The second end 350 of the second flap folding, gluing and compressing section is fastened the first end 354 of the third transfer section 24; the second end 356 of the third transfer section 24 is fastened to the first end 354 of the third flap folding, gluing and compressing section 22; and the second end 358 of the third flap folding, gluing and compressing section 22 is fastened to the first end of the outfeed section 360.

Carton Sealing Process

The preferred embodiment of the random size carton sealer 10 folds and glues two minor flaps 42, two end flaps 38 and four side flaps 40 of a corrugated cardboard carton 26. The flaps on each side of a carton 26 are folded and glued one side at a time.

The carton 26 is initially at rest on the assembly table 52, where a panel 30 to be sealed within the carton 26 is placed on the bottom wall 34 off the carton 26. (See FIG. 1.) The top wall 32 of the carton 26 is then folded over the insulation panel and the carton 26 is slid onto the infeed rollers 54 of the infeed conveyor 12. The carton 26 is slid onto the infeed conveyor 12 so that the end flaps 38 of the carton 26 are at the leading end 130 of the carton 26 as it is conveyed, in a first direction, along the infeed conveyor 12 and the first transfer section 14.

The carton 26 is conveyed to the first transfer section 14 by the infeed rollers 54 and feed roller 60. When the carton 26 passes from the infeed conveyor 12 to the first transfer section 14 the leading end 130 and trailing end 132 of the carton 26 triggers a photo eye 116 which prompts the controller to turn off the infeed rollers 54 and the feed roller 60. The trailing end 132 of the carton 26 triggers the photo eye 116 which prompts the controller to activate the pusher gate 118 after a predetermined delay. The pusher gate 118 forces the carton 26 into the guide fence 120.

The leading end 130 of the carton 26 triggers a photo eye 121 at the guide fence 120 which prompts the controller to activate the pusher gate 118 back to its initial position. The controller also activates the pusher arm 122 on the first transfer section. The pusher arm 122 pushes the carton 26 along the guide fence 120 in a second direction perpendicular to the first direction. The carton 26 is pushed until it is engaged by the presser belt 142 and the conveyor belts 244 of the first flap folding, gluing and compressing section 18.

The leading side 362 of the carton 26 triggers a photo eye 117 at the inlet of the first flap folding, gluing and compressing section (FFFGCS) 18. The photo eye 117 prompts the controller to activate the pusher arm 122 to its initial position and turn on the infeed rollers 54 and feed roller 60 back so that another carton 26 can be delivered to the first transfer section 14.

The presser belt 142 and conveyor belts 244 cooperate with the carton 26 to fix the carton 26 between these two belts 142, 244 and prevent the carton 26 from moving away from the flap plows 248, 250 and the compressing unit 258 during flap folding and gluing. (The force needed to keep a four foot wide and eight foot long carton 26 from moving away from the flap plows 248, 250 and compressing unit 258 is more than fifty pounds.) The adjustable weight floating presser plates 156 are designed to maintain a substantially constant contact pressure between the bottom run 166 of the presser belt 142 and the top wall 32 of the carton 26. Since the floating presser plates 156 can float in the vertical direction, the pressure between the bottom run 166 of the presser belt 142 and the top wall 32 of cartons 26 will not substantially change if carton 26 thickness do not vary more than the floating presser plates 156 distance to freely float.

While in the FFFGCS 18 the bottom end flap 38 of the carton 26 is folded by the bottom flap plow 250. The leading side 362 of the carton 26 passes the glue head 254 and then triggers a second photo eye 260 which prompts the controller to activate the glue supply unit 252 which supplies glue to the folded bottom flap 265. The top flap plow 248 is located so that the top flap 267 of the carton 26 is folded down onto the folded bottom flap 265 just after the glue is applied to the folded bottom flap 265. The folded bottom flap 265 and top flap 267 engage the compressing unit 58 where the glue sets. The trailing side 364 of the carton 26 triggers a first photo eye 256 located before the glue head 254. The first photo eye 256 prompts the controller to deactivate the glue supply unit 252 which ceases to supply glue to the glue head 254. Since the first photo eye 256 is located before the glue head 254, the glue head 254 stops delivering glue to the bottom flap 265 before the bottom flap 265 passes the glue head 254.

FIG. 3 illustrates a carton 26 that has had its end flaps 38 folded and glued. After the carton 26 has been conveyed through the FFFGCS 18 the presser belt 142 and the conveyor belt 244 convey the carton 26 to the second transfer section 16 where the transfer rollers 58 force the carton 26 into a guide fence 272. The leading side 362 of the carton 26 triggers a photo eye 274 which prompts the controller to activate the "L" shaped pusher arm 278. The pusher arm 278 folds the first minor flap 42 and pushes the carton 26, in a direction perpendicular to the second direction, along the guide fence 272 where a minor flap plow 286 completes folding the minor flap 42. The pusher arm 278 pushes the carton 26 until the presser belt 142 and the conveyor belt 244 of the second flap folding, gluing and compressing section (SFFGCS) 20 engage the carton 26. A photo eye 275 at the inlet of the SFFGCS 20 is triggered by the trailing end 132 of the carton 26. The photo eye 275 prompts the controller to activate the pusher arm 278 so that it returns back to its initial position.

The first set of carton 26 side flaps 40 are folded and glued over the minor flap 42 in the SFFGCS 20. The folding and gluing of the side flaps 40 in the SFFGCS 20 proceeds the same as the folding and gluing of the end flaps 38 in the FFFGCS 18. FIG. 4 illustrates a carton 26 that has had its end flaps 38 folded and glued and a first set of side flaps 40 folded and glued.

After the carton 26 has been conveyed through the SFFGCS 20 the presser belt 142 and the conveyor belts 244 convey the carton 26 onto a third transfer section 24 where the transfer rollers 58 force the carton 26 along a pusher arm 304 into contact with a rising stop gate 302. A photo eye 300 near the rising stop gate is triggered by the leading end 130 of the carton 26 and prompts the controller to activate the pusher arm 304. The pusher arm 304 pushes the carton 26, in a fourth direction perpendicular to the third direction, along the rising stop gate 302 into contact with a guide fence 298. A photo eye located above the guide fence 312 is triggered by the leading side 364 of the carton 26 and prompts the controller to activate the rising stop gate 302 so that the rising stop gate 302 drops and the transfer rollers 58 transfer the carton 26 into the third flap folding, gluing and compressing section 22 (TFFGCS).

A photo eye 320 just before the minor flap tucker 322 is triggered by the trailing end 132 of the carton 26 and the controller activates the rising stop gate 302 so that the rising stop gate 302 rises. In addition the controller activates the flap tucker 322, after a predetermined delay, wherein the flap tucker arm 326 folds the second minor flap 42 while the carton 26 is being conveyed past the flap tucker 322. A minor flap plow 324 finishes folding the second minor flap 42.

The second set of carton 26 side flaps 40 are folded and glued over the second minor flap 42 in the TFFGCS. The folding and gluing of the side flaps in the TFFGCS 22 proceeds the same as the folding and gluing of the end flaps 28 in the SFFGCS 20. FIG. 8 illustrates a carton 26 that has had its minor flaps folded, its end flaps folded and glued, a first set of side flaps 40 folded and glued and a second set of side flaps 40 folded and glued.

After the carton 26 has been conveyed through the TFFGCS 22 the presser belt 142 and the conveyor belt 244 convey the carton 26 onto an outfeed section 334 where the carton 26 triggers a photo eye (not shown). The photo eye prompts the controller to start a timer. If the carton 26 is not removed from the outfeed section 334 within a predetermined time the controller shuts the random size carton sealer 10 off.

Of course, it should be understood that various changes and modifications to the preferred embodiment described herein will be apparent to those skilled in the art. For example, compression springs could be used to increase the force with which the adjustable weight presser plate 156 forces the presser belt 142 onto the top surface of a carton 26. Such changes and modifications can be made without departing from the scope of the present invention and without diminishing its attendant advantages. It is, therefore, intended that such changes and modifications be covered by the following claims.

We claim:

1. In a carton sealing apparatus of the type for automatically folding and gluing the flaps on cartons, the carton sealing apparatus comprising a main support means, a flap folding means and a flap gluing means, the improvement comprising:

an endless presser belt including an inside surface and an outside surface, wherein the endless presser belt is adapted to contact the top surface of a carton;

an endless conveyor belt, wherein the endless conveyor belt is adapted to contact the bottom surface of the carton;

a presser belt support means including a bottom side, wherein the endless presser belt is supported by the presser belt support means and the bottom side defines a direction of travel for the endless presser belt along the bottom side of the presser belt support means;

a conveyor belt support means including a top side, wherein the endless conveyor belt is supported by the conveyor belt support means and the top side defines a direction of travel for the endless conveyor belt along the top side of the conveyor belt support means;

the main support means supporting the presser belt support means above the conveyor belt support means, wherein the direction of travel for the endless presser belt is the same as the direction of travel for the endless conveyor belt;

the main support means supporting the flap folding means and the flap gluing means such that the flap folding means and the flap gluing means can seal and close the flaps of a carton in contact with the endless presser belt and the endless conveyor belt;

the endless presser belt, the endless conveyor belt, and a carton in contact with the endless presser belt and the endless conveyor belt, cooperating to restrict movement of the carton in directions perpendicular to the direction of travel for the presser belt; at least one presser means for increasing the contact pressure between the outside surface of the endless presser belt and the top surface of the carton;

at least one endless rib extending along the inside surface of the endless presser belt; and at least one groove in the presser means adapted to receive the endless rib extending along the inside surface of the endless presser belt;

the groove defining a longitudinal axis, wherein the longitudinal axis is parallel to the direction of travel of the endless presser belt;

the endless rib and the groove cooperating to restrict the endless presser belt from moving perpendicular to the direction of travel of the endless presser belt.

2. The carton sealing apparatus of claim 1, wherein the endless conveyor belt defines an inside surface and an outside surface, the improvement further comprising:

at least one endless rib extending along the inside surface of the endless conveyor belt; and at least one groove in the top side of the conveyor belt support means adapted to receive the continuous rib extending along the inside surface of the endless conveyor belt;

the groove defining a longitudinal axis, wherein the longitudinal axis is parallel to the direction of travel of the endless conveyor belt;

the endless rib and the groove cooperating to restrict the endless conveyor belt from moving perpendicular to the direction of travel of the endless conveyor belt.

3. In a carton sealing apparatus of the type for automatically folding and gluing the flaps on cartons, the carton sealing apparatus comprising a main support means, a flap folding means and a flap gluing means, the improvement comprising:

an endless presser belt, wherein the endless presser belt is adapted to contact the top surface of a carton and wherein the endless presser belt includes a bottom run; the bottom run defining an inside surface and an outside surface adapted to contact the top surface of a carton;

an endless conveyor belt, wherein the endless conveyor belt is adapted to contact the bottom surface of the carton;

a presser belt support means including a bottom side, wherein the endless presser belt is supported by the presser belt support means and the bottom side defines a direction of travel for the endless presser belt along the bottom side of the presser belt support means;

a conveyor belt support means including a top side, wherein the endless conveyor belt is supported by the conveyor belt support means and the top side defines a direction of travel for the endless conveyor belt along the top side of the conveyor belt support means;

the main support means supporting the presser belt support means above the conveyor belt support means, wherein the direction of travel for the endless presser belt is the same as the direction of travel for the endless conveyor belt;

the main support means supporting the flap folding means and the flap gluing means such that the flap folding means and the flap gluing means can seal and close the flaps of a carton in contact with the endless presser belt and the endless conveyor belt;

the endless presser belt, the endless conveyor belt, and a carton in contact with the endless presser belt and the endless conveyor belt, cooperating to restrict movement of the carton in directions perpendicular to the direction of travel for the presser belt;

at least one floating presser plate including a top side and a bottom side, the floating presser plate increasing the contact pressure between the outside surface of the bottom run and the top surface of a carton;

a layer of friction-reducing material including a top side and a bottom side, the friction-reducing material reducing the friction between the floating presser plate and the inside surface of the bottom run, wherein the friction-reducing material is fixably attached to the bottom side of the floating presser plate and the friction-reducing material contacts the inside surface of the bottom run; at least one endless rib extending along the inside surface of the endless presser belt;

at least one groove in the bottom side of the layer of friction-reducing material adapted to receive the endless rib extending along the inside surface of the endless presser belt; the groove defining a longitudinal axis, wherein the longitudinal axis is parallel to the direction of travel of the endless presser belt; the endless rib and the groove cooperating to restrict the endless presser belt from moving perpendicular to the direction of travel of the endless presser belt, and a floating presser plate support means, wherein the floating presser plate support means allows translation of the floating presser plate in directions perpendicular to the bottom run of the endless presser belt, while restricting movement of the floating presser plate relative to the presser belt support means in directions substantially parallel to the inside surface of the bottom run of the endless presser belt.

4. The carton sealing apparatus of claim 3, wherein the endless conveyor belt includes an inside surface and an outside surface, the improvement further comprising:

at least one endless rib extending along the inside surface of the endless conveyor belt; and at least one groove in the top side of the conveyor support means adapted to receive the continuous rib extending along the inside surface of the endless conveyor belt;

the groove defining a longitudinal axis, wherein the longitudinal axis is parallel to the direction of travel of the endless conveyor belt;

the endless rib and the groove cooperating to restrict the endless conveyor belt from moving perpendicular to the first direction of travel of the endless conveyor belt.

5. In a carton sealing apparatus of the type for automatically folding and gluing the flaps on cartons, the carton sealing apparatus comprising a main support means, a flap folding means and a flap gluing means, the improvement comprising:

an endless presser belt including a top run and a bottom run, wherein the bottom run of the presser belt is adapted to contact the top surface of a carton and wherein the bottom run of the endless presser belt includes an inside surface and an outside surface and the outside surface of the bottom run is adapted to contact the top surface of a carton;

an endless conveyor belt including a top run, wherein the top run of the conveyor belt is adapted to contact the bottom surface of the carton;

a presser belt support structure including a top side and a bottom side, wherein the top side supports the top run of the endless presser belt and the bottom side defines a direction of travel for the bottom run of the endless presser belt along the bottom side of the presser belt support structure; and wherein the presser belt support structure comprises:

a first presser belt support roller defining a longitudinal axis;

a second presser belt support roller defining a longitudinal axis;

a first side frame defining a longitudinal axis;

a second side frame defining a longitudinal axis;

a top run support means, wherein the top run support means is fixably mounted to the first side frame;

a side frame support means; and a presser belt support roller drive means, wherein the drive means is adapted to rotate a presser belt support roller about its longitudinal axis;

the first side frame and the second side frame supported by the side frame support means such that the longitudinal axis of the first side frame is parallel with the longitudinal axis of the second side frame;

the first presser belt support roller and the second presser belt support roller each rotatively mounted to the first side frame and the second side frame such that the longitudinal axis of the first presser belt support roller is parallel to the longitudinal axis of the second presser belt support roller;

a conveyor belt support structure including a top side, wherein the top side supports the top run of the endless conveyor belt and defines a direction of travel for the top run of the endless conveyor belt along the top side of the conveyor belt support structure;

the main support means supporting the presser belt support structure above the conveyor belt support structure, wherein the direction of travel for the bottom run of the endless presser belt is the same as the direction of travel for the top run of the endless conveyor belt and the bottom run of the endless presser belt is substantially parallel to the top run of the endless conveyor belt;

the main support means supporting the flap folding means and the flap gluing means such that the flap folding means and the flap gluing means can fold and glue the flaps on one side of a carton in contact with the endless presser belt and the endless conveyor belt;

the endless presser belt, the endless conveyor belt and a carton in contact with the endless presser belt and the endless conveyor belt, cooperating to restrict movement of the carton in directions perpendicular to the direction of travel for the endless presser belt;

at least one floating presser plate including a top side and a bottom side, wherein the floating presser plate increases the contact pressure between the outside surface of the bottom run of the endless presser belt and the top surface of a carton;

at least one endless guide rib extending along the inside surface of the endless presser belt;

at least one groove in the bottom side of the floating presser plate adapted to receive the endless rib extending along the inside surface of the endless presser belt; the groove defining a longitudinal axis, wherein the longitudinal axis is parallel to the direction of travel of the endless presser belt; the endless rib and the groove cooperating to restrict the endless presser belt from moving perpendicular to the direction of travel of the endless presser belt; and a floating presser plate support means; the floating presser plate support means fixably mounted to the first side frame, wherein the floating presser plate support means allows translation of the floating presser plate in directions perpendicular to the bottom run of the endless presser belt, while restricting movement of the floating presser plate relative to the presser belt support means in directions parallel to the inside surface of the bottom run of the endless presser belt.

6. The carton sealing apparatus of claim 5 the bottom side of the floating presser plate comprising:

a first layer of friction-reducing material; the friction-reducing material reducing the friction between the floating presser plate and the inside surface of the bottom run, wherein the friction-reducing material is fixably attached to the bottom side of the presser plate and the friction-reducing material contacts the inside surface of the bottom run.

7. The carton sealing apparatus of claim 5 wherein the conveyor belt support structure comprises:

a first conveyor belt support roller defining a longitudinal axis;

a second conveyor belt support roller defining a longitudinal axis;

a first side frame;

a top run support means defining a top side, wherein the top run support means is fixably mounted to the first side frame;

at least one endless guide rib extending along the inside surface of the endless conveyor belt;

at least one groove in the top side of the top run support means adapted to receive the endless guide rib extending along the inside surface of the endless presser belt; the groove defining a longitudinal axis; the longitudinal axis parallel to the direction of travel of the endless conveyor belt, wherein the endless rib and the groove cooperate to restrict the endless conveyor belt from moving perpendicular to the direction of travel of the endless conveyor belt; and a conveyor belt support roller drive means, wherein the drive means is adapted to rotate a conveyor belt support roller about its longitudinal axis;

the first conveyor belt support roller and the second conveyor belt support roller each rotatively mounted to the first side frame such that the longitudinal axis of the first conveyor belt support roller is parallel to the longitudinal axis of the second conveyor belt support roller.

8. The carton sealing apparatus of claim 7, the top run support means comprising' a first layer of friction-reducing material; the friction-reducing material reducing the friction between the top run support means and the inside surface of the top run of the endless conveyor belt, wherein the friction-reducing material is fixably attached to the top side of the top run support means and the friction-reducing material is in contact with the inside surface of the top run of the endless conveyor belt.

9. The carton sealing apparatus of claim 8, the main support means comprising:

means for adjusting the distance between the presser belt support structure and the conveyor belt support structure, wherein the distance between the presser belt support structure and the conveyor belt support structure can be adjusted such that the flaps of different thickness cartons can be folded and glued.

10. The carton sealing apparatus of claim 9, the improvement further comprising:

at least one carton infeed means; the carton infeed means adapted to convey a carton to the endless presser belt and the endless conveyor belt, wherein the infeed means aligns the carton for flap folding and flap gluing before it is conveyed to the endless presser belt and the endless conveyor belt; and an infeed control means; the control means adapted to control the carton infeed means such that there is, at most, one carton between the endless presser belt and the endless conveyor belt at a given point in time.

11. In a carton sealing apparatus of the type for automatically folding and gluing the flaps on cartons, the carton sealing apparatus comprising at least three main support means, at least three flap folding means and at least three flap gluing means, the improvement comprising:

a first, second and third endless presser belt each including a top run and a bottom run; the bottom run defining an outside surface and an inside surface, wherein the outside surface of the bottom run is adapted to contact the top surface of a carton;

at least one endless guide rib extending along the inside surface of each endless presser belt;

a first, second and third endless conveyor belt each including a top run, wherein the top run of the endless conveyor belts is adapted to contact the bottom surface of a carton;

a first, second and third floating presser plate each including a top side and a bottom side, wherein the floating presser plate increase the contact pressure between the outside surface of the bottom run of one endless presser belt and the top surface of a carton;

at least one groove in the bottom side of the floating presser plates adapted to receive the endless guide rib extending along the inside surface of one endless presser belt; the groove defining a longitudinal axis, wherein the longitudinal axis is parallel to the direction of travel of the endless presser belt; the endless guide rib and the groove cooperating to restrict the endless presser belt from moving perpendicular to the direction of travel of the endless presser belt;

a first, second and third presser belt support structure each including a top side and a bottom side, wherein each top side supports the top run of one endless presser belt and each bottom side defines a direction of travel for the bottom run of one endless presser belt along the bottom side of each presser belt support structure;

a first, second and third floating presser plate support means; each floating presser plate support means fixably mounted to one presser belt support structure, wherein each floating presser plate support means allows translation of the floating presser plate in directions perpendicular to the bottom run of one endless presser belt, while restricting movement of one floating presser plate relative to the presser belt support means in directions parallel to the inside surface of the bottom run of one endless presser belt; and a first, second and third conveyor belt support structure each including a top side, wherein each top side supports the top run of one endless conveyor belt and defines a direction of travel for the top run of one endless conveyor belt along the top side of the conveyor belt support structure;

each main support means supporting one presser belt support structure and one endless presser belt above one conveyor belt support structure and one endless conveyor belt, wherein the direction of travel for the bottom run of one endless presser belt is the same as the direction of travel for the top run of one endless conveyor belt; the bottom run of the presser belt substantially parallel to the top run of the conveyor belt;

each main support means supporting one flap folding means and one flap gluing means, wherein the flap folding means and the flap gluing means are supported such that they fold and glue the flaps on one side of a carton in contact with one endless presser belt and one endless conveyor belt;

one endless presser belt, the presser belt support structure, one endless conveyor belt, the conveyor belt support structure, and a carton in contact with the endless presser belt and the endless conveyor belt, cooperating to restrict movement of the carton in directions perpendicular to the direction of travel for the presser belt.

12. The carton sealing apparatus of claim 11 wherein each presser belt support structure comprises:

a first presser belt support roller defining a longitudinal axis;

a second presser belt support roller defining a longitudinal axis;

a first side frame defining a longitudinal axis;

a second side frame defining a longitudinal axis;

a top run support means, wherein the top run support means is fixably mounted to the first side frame;

a side frame support means; and a presser belt support roller drive means, wherein the drive means is adapted to rotate the first presser belt support roller about its longitudinal axis;

the first side frame and the second side frame supported by the side frame support means such that the longitudinal axis of the first side frame is parallel with the longitudinal axis of the second side frame;

the first presser belt support roller and the second presser belt support roller each rotatively mounted to the first side frame and the second side frame such that the longitudinal axis of the first presser belt support roller is parallel to the longitudinal axis of the second presser belt support roller.

13. The carton sealing apparatus of claim 12 wherein each conveyor belt support structure comprises:

a first conveyor belt support roller defining a longitudinal axis;

a second conveyor belt support roller defining a longitudinal axis;

a first side frame;

a top run support means defining a top side, wherein the top run support means is fixably mounted to the first side frame;

at least one endless guide rib extending along the inside surface of the endless conveyor belt;

at least one groove in the top side of the top run support means adapted to receive the endless guide rib extending along the inside surface of one endless conveyor belt; the groove defining a longitudinal axis; the longitudinal axis parallel to the direction of travel of the endless conveyor belt, wherein the endless rib and the groove cooperate to restrict the endless conveyor belt from moving perpendicular to the direction of travel of the endless conveyor belt; and a conveyor belt support roller drive means, wherein the drive means is adapted to rotate the first conveyor belt support roller about its longitudinal axis;

the first conveyor belt support roller and the second conveyor belt support roller each rotatively mounted to the first side frame such that the longitudinal axis of the first conveyor belt support roller is parallel to the longitudinal axis of the second conveyor belt support roller.

14. The carton sealing apparatus of claim 13, the bottom side of each floating presser plate comprising:

a layer of friction-reducing material;

the friction-reducing material fixably attached to the bottom side of each floating presser plate, wherein the friction-reducing material contacts the inside surface of the bottom run of one endless presser belt and reduces friction between each floating presser plate and the inside surface of the bottom run of one endless presser belt.

15. The carton sealing apparatus of claim 14, the top side of each conveyor belt support structure comprising:

a first layer of friction-reducing material;

the friction-reducing material fixably attached to the top side of each conveyor belt support structure, wherein the friction-reducing material contacts the inside surface of the top run of one endless conveyor belt and reduces friction between the top side of each conveyor belt support structure and the inside surface of the top run of one endless conveyor belt.

16. The carton sealing apparatus of claim 13, the improvement comprising:

a minor flap folding plow; and a minor flap tucker;

the minor flap folding plow and the minor flap tucker cooperating to fold at least one minor flap on a carton.

17. The carton sealing apparatus of claim 13, the improvement further comprising:

at least one carton infeed means; the carton infeed means adapted to convey a carton to the first endless presser belt supported above the first endless conveyor belt, wherein the infeed means aligns the carton for flap folding and flap gluing before it is conveyed to the first endless presser belt and the first endless conveyor belt; and an infeed control means; the control means adapted to control the carton infeed means such that there is, at most, one carton between the first endless presser belt and the first endless conveyor belt at a given point in time.

18. The carton sealing apparatus of claim 17, the carton infeed means comprising:

an infeed conveyor for conveying cartons;

a transfer section for conveying cartons;

a guide fence;

a one way pusher gate;

an infeed conveyor control means; and a pusher arm;

the infeed conveyor supplying the transfer section with cartons, such that there is, at most, one carton on the transfer section at a given point in time, the one way pusher gate pushing the carton into contact with the guide fence and the pusher arm pushing a carton into contact with the first endless presser belt supported above the first endless conveyor belt, wherein the infeed conveyor conveys cartons at a slower speed than the transfer section and the infeed control means stops movement of cartons on the infeed conveyor while one carton is on the transfer section.

19. The carton sealing apparatus of claim 18, the improvement further comprising a carton transfer section, wherein the carton transfer section comprises:

a conveyor;

a guide fence;

a pusher arm; and a pusher arm control means;

the conveyor moving a carton into contact with the guide fence and the pusher arm control means activating the pusher arm when the carton is in contact with the guide fence, wherein the carton is supplied to the conveyor by the first endless presser belt and the second presser belt and the pusher arm pushes the carton into contact with the second presser belt supported above the second presser belt.

20. The carton sealing apparatus of claim 11, the improvement further comprising:

at least one floating presser plate weight; and a floating presser plate weight attachment means for fixably mounting the floating presser plate weight onto the top side of one floating presser plate.

21. In a carton sealing apparatus of the type for automatically folding and gluing the flaps on cartons, the carton sealing apparatus comprising a main support means, a flap folding means and a flap gluing means, the improvement comprising:

an endless presser belt; and a floating presser plate positioned to force the endless presser belt into contact with a surface of the carton.

22. The carton sealing apparatus of claim 21, the improvement further comprising:

a presser belt support means including a bottom side, wherein the endless presser belt is supported by the presser belt support means and the bottom side defines a direction of travel for the endless presser belt along the bottom side of the presser belt support means; and an endless conveyor belt, wherein the endless conveyor belt is adapted to contact a surface of the carton;

the endless presser belt and the endless conveyor belt cooperating to restrict movement of the carton in directions perpendicular to the direction of travel of the presser belt.

23. The carton sealing apparatus of claim 22, wherein the endless presser belt includes an inside surface and an outside surface, the improvement further comprising:

an endless rib extending along the inside surface of the endless presser belt; and a groove in the floating presser plate adapted to receive the endless rib;

the groove defining a longitudinal axis, wherein the longitudinal axis is parallel to the direction of travel of the endless presser belt;

the endless rib and the groove cooperating to restrict the endless presser belt from moving perpendicular to the direction of travel of the endless presser belt.

24. The carton sealing apparatus of claim 21, wherein the endless presser belt includes a bottom run which defines an inside surface and an outside surface, the improvement further comprising:

a floating presser plate support means, wherein the floating presser plate support means restricts movement of the floating presser plate in directions parallel to the inside surface of the bottom run of the endless presser plate.

25. The carton sealing apparatus of claim 21, wherein the endless presser belt includes a bottom run which defines an inside surface and an outside surface and the floating presser plate includes a top side and a bottom side, the improvement further comprising:

a layer of friction-reducing material including a top side and a bottom side, the friction-reducing material reducing the friction between the floating presser plate and the inside surface of the bottom run, wherein the friction-reducing material is fixably attached to the bottom side of the floating presser plate and the friction-reducing material contacts the inside surface of the bottom run.

* * * * *